US008191476B2

(12) United States Patent
Rastegar et al.

(10) Patent No.: US 8,191,476 B2
(45) Date of Patent: Jun. 5, 2012

(54) MULTI-STAGE MECHANICAL DELAY MECHANISMS FOR INERTIAL IGNITERS FOR THERMAL BATTERIES AND THE LIKE HAVING A ROTATABLE MOVABLE MEMBER

(75) Inventors: Jahangir S. Rastegar, Stony Brook, NY (US); Thomas Spinelli, Northport, NY (US); Richard T. Murray, Brentwood, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 177 days.

(21) Appl. No.: 12/512,008

(22) Filed: Jul. 29, 2009

(65) Prior Publication Data

US 2009/0288571 A1 Nov. 26, 2009

Related U.S. Application Data

(62) Division of application No. 11/888,815, filed on Aug. 2, 2007, now Pat. No. 7,587,979.

(51) Int. Cl.
*F42C 15/24* (2006.01)

(52) U.S. Cl. ..... 102/247; 102/220; 102/251; 102/254

(58) Field of Classification Search ..... 102/247, 102/251, 253, 254, 221, 222
See application file for complete search history.

(56) References Cited

U.S. PATENT DOCUMENTS 3,369,520 A * 2/1968 Burg et al. ..... 116/203
5,188,393 A * 2/1993 Fohl ..... 280/806
5,670,764 A * 9/1997 Sakamoto et al. ..... 200/61.45 R

* cited by examiner

*Primary Examiner* — Michael Carone
*Assistant Examiner* — Daniel Troy

(57) ABSTRACT

An inertia igniter including a mechanical delay mechanism having two or more members which are movable under different acceleration conditions to sequentially move a movable member upon sequential movement of the two or more members and an ignition member actuatable by the movable member such that movement of the movable member by the two or more members ignites the ignition member. The movable member can be movable by one of translation and rotation. The inertia igniter can further comprise an impact mass releasably movable in the housing, wherein the impact mass is released and movable by movement of the movable member to impact the ignition member. The inertia igniter can also further comprise a stop member for preventing movement of the impact mass until the movable member has moved a predetermined distance.

15 Claims, 20 Drawing Sheets

MULTI-STAGE MECHANICAL DELAY MECHANISMS FOR INERTIAL IGNITERS FOR THERMAL BATTERIES AND THE LIKE HAVING A ROTATABLE MOVABLE MEMBER

CROSS-REFERENCE TO RELATED APPLICATIONS

The present application is a divisional application of U.S. application Ser. No. 11/888,815 filed on Aug. 2, 2007, which claims priority to U.S. provisional patent application Ser. No. 60/835,023, filed on Aug. 2, 2006, the entire contents of each of which is incorporated herein by reference.

BACKGROUND OF THE INVENTION

1. Field of the Invention

The present invention relates generally to multi-stage acceleration (deceleration) operated mechanical delay mechanisms, and more particularly for inertial igniters for thermal batteries used in gun-fired munitions and other similar applications.

2. Prior Art

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In recent years, new improved chemistries and manufacturing processes have been developed that promise the development of lower cost and higher performance thermal batteries that could be produced in various shapes and sizes, including their small and miniaturized versions. However, the existing inertial igniters are relatively large and not suitable for small and low power thermal batteries, particularly those that are being developed for use in miniaturized fuzing, future smart munitions, and other similar applications.

A schematic of a cross-section of a thermal battery and inertial igniter assembly of the prior art is shown in FIG. 1. In thermal battery applications, the inertial igniter 10 (as assembled in a housing) is either positioned above the thermal battery housing 11 as shown in FIG. 1 or within the thermal battery itself (not shown). When positioned outside the thermal battery as shown in FIG. 1, upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height. When the inertial igniter is positioned inside the thermal battery itself, the total volume of the igniter must be reduced to minimally add to the total volume of the thermal battery.

With currently available inertial igniters of the prior art (e.g., produced by Eagle Picher Technologies, LLC), a schematic of which is shown in FIG. 2, the inertial igniter 20 has to be positioned within a housing 21 as shown in FIG. 3. The housing 21 and the thermal battery housing 11 may share a common cap 22, with the opening 25 to allow the ignition fire to reach the pyrotechnic material 24 within the thermal battery housing. As the inertial igniter is initiated, the sparks can ignite intermediate materials 23, which can be in the form of thin sheets to allow for easy ignition, which would in turn ignite the pyrotechnic materials 24 within the thermal battery through the access hole 25.

A schematic of a cross-section of a currently available inertial igniter 20 is shown in FIG. 2 in which the acceleration is in the upward direction (i.e., towards the top of the paper). The igniter has side holes 26 to allow the ignition fire to reach the intermediate materials 23 as shown in FIG. 3, which necessitate the need for its packaging in a separate housing, such as in the housing 21. The currently available inertial igniter 20 is constructed with an igniter body 60. Attached to the base 61 of the housing 60 is a cup 62, which contains one part of a two-part pyrotechnic compound 63 (e.g., potassium chlorate). The housing 60 is provided with the side holes 26 to allow the ignition fire to reach the intermediate materials 23 as shown in FIG. 3. A cylindrical shaped part 64, which is free to translate along the length of the housing 60, is positioned inside the housing 60 and is biased to stay in the top portion of the housing as shown in FIG. 2 by the compressively preloaded helical spring 65 (shown schematically as a heavy line). A turned part 71 is firmly attached to the lower portion of the cylindrical part 64. The tip 72 of the turned part 71 is provided with cut rings 72*a*, over which is covered with the second part of the two-part pyrotechnic compound 73 (e.g., red phosphorous).

A safety component 66, which is biased to stay in its upper most position as shown in FIG. 2 by the safety spring 67 (shown schematically as a heavy line), is positioned inside the cylinder 64, and is free to move up and down (axially) in the cylinder 64. As can be observed in FIG. 2, the cylindrical part 64 is locked to the housing 60 by setback locking balls 68. The setback locking balls 68 lock the cylindrical part 64 to the housing 60 through holes 69*a* provided on the cylindrical part 64 and the housing 60 and corresponding holes 69*b* on the housing 60. In the illustrated configuration, the safety component 66 is pressing the locking balls 68 against the cylindrical part 64 via the preloaded safety spring 67, and the flat portion 70 of the safety component 66 prevents the locking balls 68 from moving away from their aforementioned locking position. The flat portion 70 of the safety component 66 allows a certain amount of downward movement of the safety component 66 without releasing the locking balls 68 and thereby allowing downward movement of the cylindrical part 64. For relatively low axial acceleration levels or higher acceleration levels that last a very short amount of time, corresponding to accidental drops and other similar situations that cause safety concerns, the safety component 66 travels up and down without releasing the cylindrical part 64. However, once the firing acceleration profiles are experienced, the safety component 66 travels downward enough to release balls 68 from the holes 69*b* and thereby release the cylindrical part 64. Upon the release of the safety component 66 and appropriate level of acceleration for the cylindrical part 64 and all other components that ride with it to overcome the resisting force of the spring 65 and attain enough momentum, then it will cause impact between the two components 63 and 73 of the two-part pyrotechnic compound with enough strength to cause ignition of the pyrotechnic compound.

The aforementioned currently available inertial igniters have a number of shortcomings for use in thermal batteries, specifically, they are not useful for relatively small thermal batteries for munitions with the aim of occupying relatively small volumes, i.e., to achieve relatively small height total igniter compartment height 13 (FIG. 1). Firstly, the currently available inertial igniters, such as that shown in FIG. 2 are relatively long thereby resulting in relatively long total igniter heights 13. Secondly, since the currently available igniters are not sealed and exhaust the ignition fire out from the sides, they have to be packaged in a housing 21, usually with other ignition material 23, thereby increasing the height 13 over the length of the igniter 20 (FIG. 3). In addition, since the pyrotechnic materials of the currently available igniters 20 are not sealed inside the igniter, they are prone to damage by the elements and cannot usually be stored for long periods of time before assembly into the thermal batteries unless they are stored in a controlled environment.

SUMMARY OF THE INVENTION

The need to differentiate accidental and initiation accelerations by the resulting impulse level of the event necessitates the employment of a safety system which is capable of allowing initiation of the igniter only during high total impulse levels. The safety mechanism described herein is a mechanical delay mechanism, which responds to acceleration applied to the inertial igniter. If the applied acceleration reaches or passes the designed initiation levels and if its duration is long enough, i.e., larger than any expected to be experienced as the result of accidental drops or explosions in their vicinity or other non-firing events, i.e., if the resulting impulse levels are lower than those indicating gun-firing, then the delay mechanism returns to its original pre-acceleration configuration, and a separate initiation system is not actuated or released to provide ignition of the pyrotechnics. Otherwise, the separate initiation system is actuated or released to provide ignition of the pyrotechnics.

Inertia-based igniters must therefore comprise two components so that together they provide the aforementioned mechanical safety (mechanical delay mechanism) and to provide the required striking action to achieve ignition of the pyrotechnic elements. The function of the safety system is to prevent the striker mechanism to initiate the pyrotechnic, i.e., to delay full actuation or release of the striker mechanism until a specified acceleration time profile has been experienced. The safety system should then fully actuate or release the striker, allowing it to accelerate toward its target under the influence of the remaining portion of the specified acceleration time profile and/or certain spring provided force. The ignition itself may take place as a result of striker impact, or simply contact or proximity or a rubbing action. For example, the striker may be akin to a firing pin and the target akin to a standard percussion cap primer. Alternately, the striker-target pair may bring together one or more chemical compounds whose combination with or without impact or a rubbing will set off a reaction resulting in the desired ignition.

Herein is described multi-stage mechanical delay mechanisms that provide very long time delays (as compared to prior art mechanisms) when subjected to acceleration in a specified direction in very small size and volume packages (as compared to prior art mechanisms). The mechanisms take advantage of the quadratic nature of time and the distance traveled under an applied acceleration. The mechanisms are particularly suitable for inertial igniters. Also disclosed are a number of inertial igniter embodiments that combine such mechanical delay mechanisms (safety systems) with impact or rubbing or contact based initiation systems.

In addition to having a required acceleration time profile which will actuate the device, requirements also commonly exist for non-actuation and survivability. For example, the design requirements for actuation for one application are summarized as:

1. The device must fire when given a [square] pulse acceleration of 900 G±150 G for 15 ms in the setback direction.

2. The device must not fire when given a [square] pulse acceleration of 2000 G for 0.5 ms in any direction.

3. The device must not actuate when given a ½-sine pulse acceleration of 490 G (peak) with a maximum duration of 4 ms.

4. The device must be able to survive an acceleration of 16,000 G, and preferably be able to survive an acceleration of 50,000 G.

A need therefore exists for the development of novel methods and resulting mechanical delay mechanisms for miniature inertial igniters for thermal batteries used in gun fired munitions, particularly for small and low power thermal batteries that could be used in fuzing and other similar applications that occupy very small volumes and eliminate the need for external power sources. The development of such novel miniature inertial ignition mechanism concepts also requires the identification or design of appropriate pyrotechnics and their initiation mechanisms. The innovative inertial igniters would preferably be scalable to thermal batteries of various sizes, in particular to miniaturized igniters for small size thermal batteries. Such inertial igniters must in general be safe and in particular they should not initiate if dropped, e.g., from up to 7 feet onto a concrete floor for certain applications; should withstand high firing accelerations, for example up to and in certain cases over 20-50,000 Gs; and should be able to be designed to ignite at specified acceleration levels when subjected to such accelerations for a specified amount of time to match the firing acceleration experienced in a gun barrel as compared to high G accelerations experienced during accidental falls which last over very short periods of time, for example accelerations of the order of 1000 Gs when applied for 5 msec as experienced in a gun as compared to for example 2000 G acceleration levels experienced during accidental fall over a concrete floor but which may last only 0.5 msec. Reliability is also of much concern since the rounds should have a shelf life of up to 20 years and could generally be stored at temperatures of sometimes in the range of −65 to 165 degrees F. This requirement is usually satisfied best if the igniter pyrotechnic is in a sealed compartment. The inertial igniters must also consider the manufacturing costs and simplicity in design to make them cost effective for munitions applications.

To ensure safety and reliability, inertial igniters should not initiate during acceleration events which may occur during manufacture, assembly, handling, transport, accidental drops, or other similar accidental events. Additionally, once under the influence of an acceleration profile particular to the firing of ordinance from a gun, the device should initiate with high reliability. In many applications, these two requirements often compete with respect to acceleration magnitude, but differ greatly in impulse. For example, an accidental drop may well cause very high acceleration levels—even in some cases higher than the firing of a shell from a gun. However, the duration of this accidental acceleration will be short, thereby subjecting the inertial igniter to significantly lower resulting impulse levels. It is also conceivable that the igniter will experience incidental low but long-duration accelerations, whether accidental or as part of normal handling, which must be guarded against initiation. Again, the impulse given to the miniature inertial igniter will have a great disparity with that given by the initiation acceleration profile because the magnitude of the incidental long-duration acceleration will be quite low.

Those skilled in the art will appreciate that the basic novel method for the development of multi-stage mechanical time delay mechanisms, the resulting mechanical time delay mechanisms, and the resulting inertial igniters disclosed herein may provide one or more of the following advantages over prior art mechanical time delay mechanisms and resulting inertial igniters in addition to the previously indicated advantages:

provide mechanical time delay mechanisms that are significantly shorter and occupy significantly less volume than currently available one stage mechanical time delay mechanisms;

provide mechanical time delay mechanisms with almost any possible time delay period that may be required for inertial igniters and other similar applications;

provide inertial igniters that are significantly shorter than currently available inertial igniters for thermal batteries or the like, particularly for relatively small thermal batteries to be used in munitions without occupying very large volumes;

provide inertial igniters that can be mounted directly onto the thermal batteries without a housing (such as housing 21 shown in FIG. 3), thereby allowing even a smaller total height for the inertial igniter assembly;

provide inertial igniters that can directly initiate the pyrotechnics materials inside the thermal battery without the need for intermediate ignition material (such as the additional material 23 shown in FIG. 3) or a booster; and provide inertial igniters that can be sealed to simplify storage and increase their shelf life.

In this disclosure, a novel and basic method is presented that can be used to develop highly compact and long delay time mechanisms for miniature inertial igniters for thermal batteries and the like. The method is based on a "domino" type of sequential displacement or rotation of inertial elements to achieve very large total displacements in a compact space. In this process, one inertial element must complete its motion due to the imparted impulse before the next element is released to start its motion. As a result, the maximum speed that is reached by each element is controlled, thereby allowing the system to achieve maximum delay times. This process is particularly effective in reducing the required length (angle) of travel of the aforementioned inertial elements due to the aforementioned quadratic nature of time and the distance traveled by an inertial element under an applied acceleration.

BRIEF DESCRIPTION OF THE DRAWINGS

These and other features, aspects, and advantages of the apparatus of the present invention will become better understood with regard to the following description, appended claims, and accompanying drawings where:

FIG. 10*a* illustrates the inertia igniter without a top cover and FIG. 10*b* is a cut-away illustration to clearly show its internal components.

DETAILED DESCRIPTION OF THE PREFERRED EMBODIMENT

Figure 1:
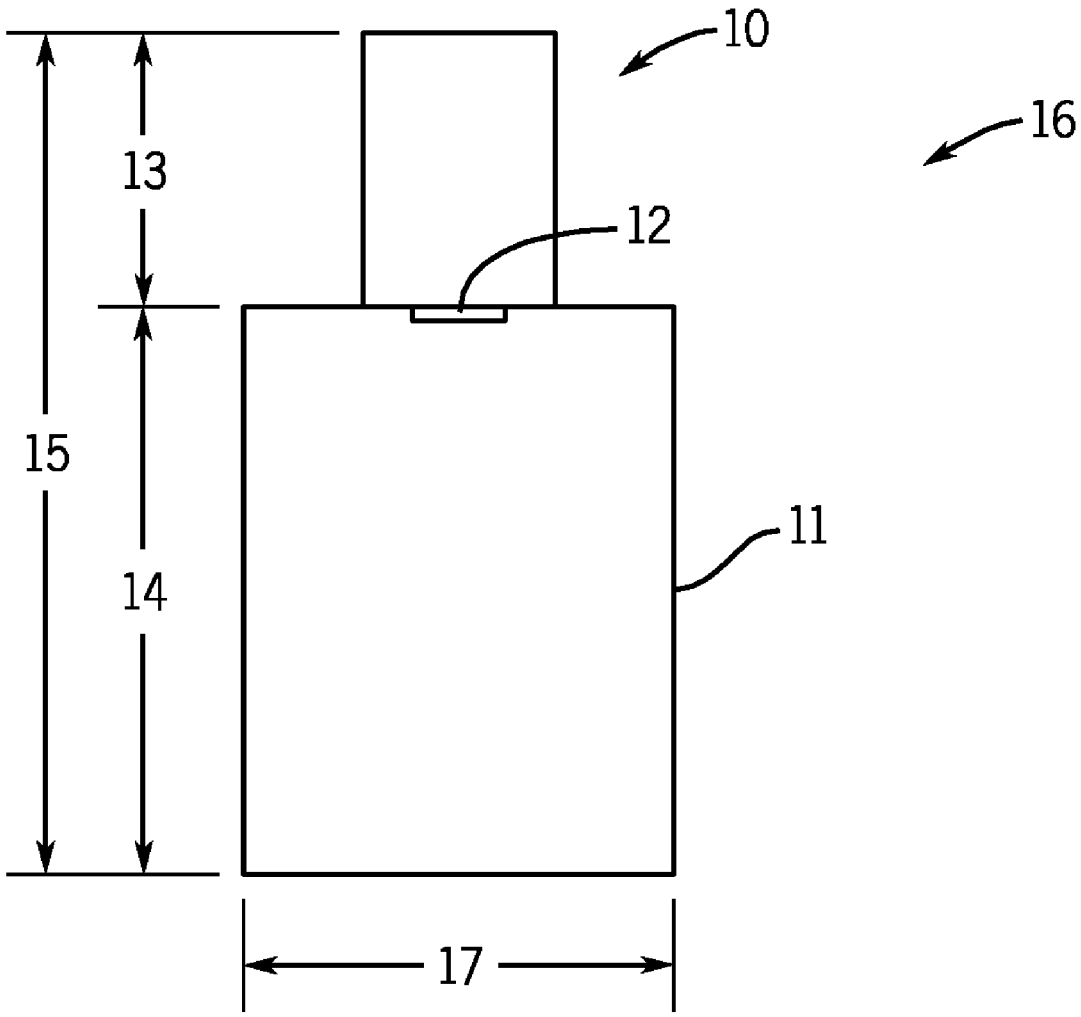
FIG. 1 (PRIOR ART)
FIG. 1 illustrates a schematic of a thermal battery and inertial igniter assembly of the prior art.
Figure 4:
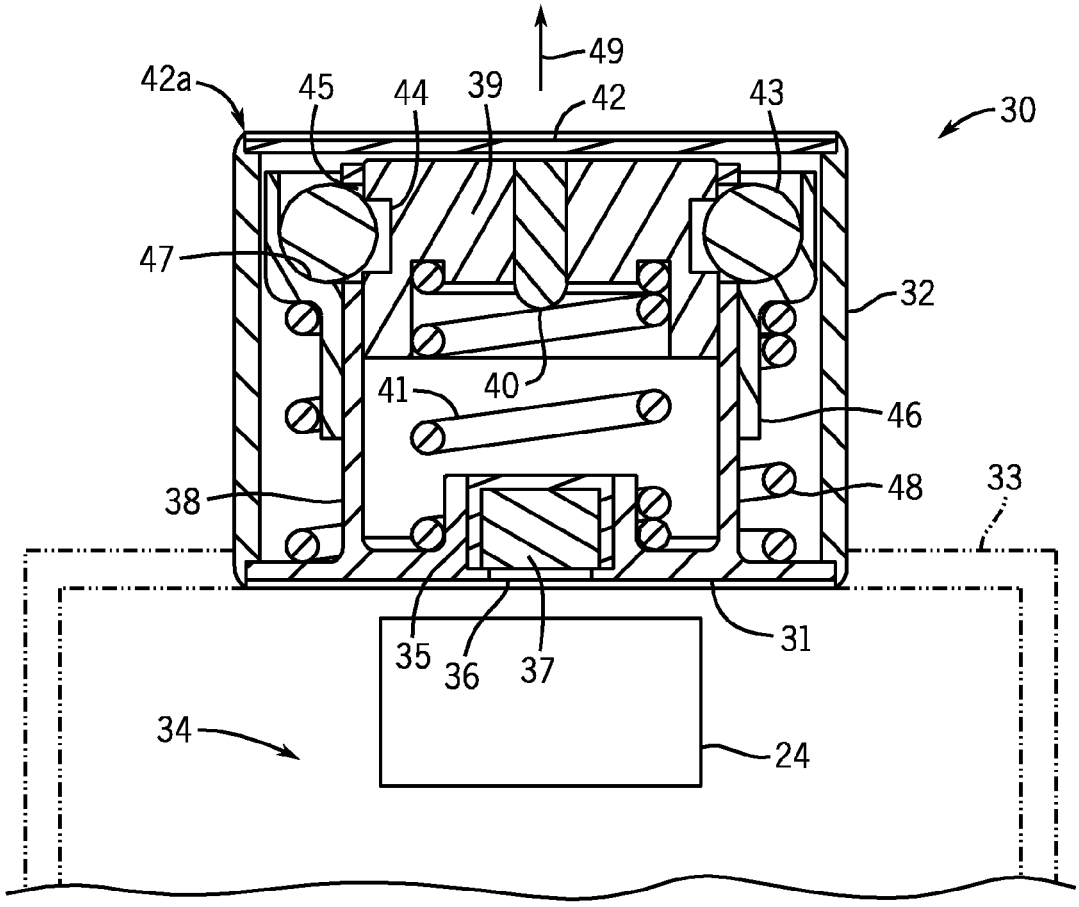
FIG. 4 illustrates a schematic of a cross-section of an embodiment of an inertia igniter.

A schematic of an embodiment of an inertial igniter design which reduces the height of the inertial igniter component 13 (FIG. 1) is shown in FIG. 4. In such embodiment, the height 13 is reduced by over 45% as compared to the height required for the currently available igniters shown in FIG. 2 (see U.S. patent application Ser. No. 11/599,878, filed on Nov. 15, 2006, the contents of which is incorporated herein by its reference). In FIG. 4, the schematic of a cross-section of an embodiment 30 of the inertia igniter is shown, which is referred to generally with reference numeral 30. The inertial igniter 30 is constructed with an igniter body 31 and a housing wall 32. In the schematic of FIG. 4, the igniter body 31 and the housing wall 32 are joined together at one end; however, the two components may be integrated as one piece. In addition, the base of the housing 31 may be extended to form the cap 33 of the thermal battery 34, the top portion of which is shown with dashed lines in FIG. 4. The base of the housing 31 is provided with a recess 35 to receive the percussion cap primer 37 (two component pyrotechnic compounds may be used instead). The base of the housing 31 is also provided with the opening 36 within the recess 35 to allow the ignited sparks and fire to exit the primer 37 into the thermal battery 34 upon initiation of the percussion cap primer 37. The internal components of the inertial igniter 30 are sealed by a cap 42 which can be fastened by any means known in the art or adhered by brazing or welding at seam 42*a* or applied with a suitable adhesive.

Integral to the igniter housing 31 is a cylindrical part 38 (or bodies with other cross-sectional shapes) having a wall defining a cavity, within which a striker mass 39 can travel up and down. The striker mass 39 is however biased to stay in its upper most position as shown in FIG. 4 by a striker spring 41. In its illustrated position, the striker mass 39 is locked in its axial position to the cylindrical part 38 of the housing 31 of the inertial igniter 30 by at least one locking ball 43. The setback locking ball 43 locks the striker mass 39 to the cylindrical part 38 of the housing 31 through the holes 45 provided on the cylindrical part 38 of the housing 31 and a concave portion such as a groove (or dimple) 44 on the striker mass 39 as shown in FIG. 4. In the configuration shown in FIG. 4, the locking balls 43 are prevented from moving away from their aforementioned locking position by the cylindrical setback collar 46. The cylindrical setback collar 46 can ride on the outer surface of the cylindrical part 38 of the housing 31, but is biased to stay in its upper most position as shown in the schematic of FIG. 4 by the setback spring 48. The cylindrical setback collar 46 has a concave portion such as an upper enlarged shoulder portion 47, within which the locking balls 43 loosely fit and are kept in their aforementioned position locking the striker mass 39 to the cylindrical part 38 of the housing 31. The striker mass 39 has a tip 40, which upon release of the striker mass and appropriate level of acceleration for the striker mass 39 to overcome the resisting force of the striker spring 41 and strike the percussion cap primer 37 with enough momentum, would initiate the percussion cap primer 37.

The basic operation of the disclosed inertial igniter 30 is as follows. Any non-trivial acceleration in the axial direction 49 which can cause the cylindrical setback collar 46 to overcome the resisting force of the setback spring 48 will initiate and sustain some downward motion of only the setback collar 46. The force due to the acceleration on the striker mass 39 is supported by the locking balls 43 which are constrained by the shoulder 47 of the setback collar 46 to engage the striker mass.

If an acceleration time in the axial direction 49 imparts a sufficient impulse to the setback collar 46 (i.e., if an acceleration time profile is greater than a predetermined threshold), it will translate down along the axis of the assembly until the setback locking balls 43 are no longer constrained to engage the striker mass 39 to the cylindrical part 38 of the housing 31. If the acceleration event is not sufficient to provide this motion (i.e., the acceleration time profile is less than the predetermined threshold), the setback collar will return to its start position under the force of the setback spring.

Assuming that the acceleration time profile was at or above the specified "all-fire" profile, the setback collar 46 will have translated down full-stroke, allowing the striker mass 39 to accelerate down towards the percussion cap primer 37. In such a situation, since the locking balls 43 are no longer constrained by the shoulder 42 of the setback collar 46, the downward force that the striker mass 39 has been exerting on the locking balls 43 will force the locking balls 43 to move in the radial direction toward the housing wall 32. Once the locking balls 43 are tangent to the outermost surface of the striker mass 39, the downward motion of the striker mass 39 is impeded only by the elastic force of the striker spring 41, which is easily overcome by the impulse provided to the striker mass 39. As a result, the striker mass 39 moves downward, causing the tip 40 of the striker mass 39 to strike the target percussion cap primer 37 with the requisite energy to initiate ignition.

Figure 2:
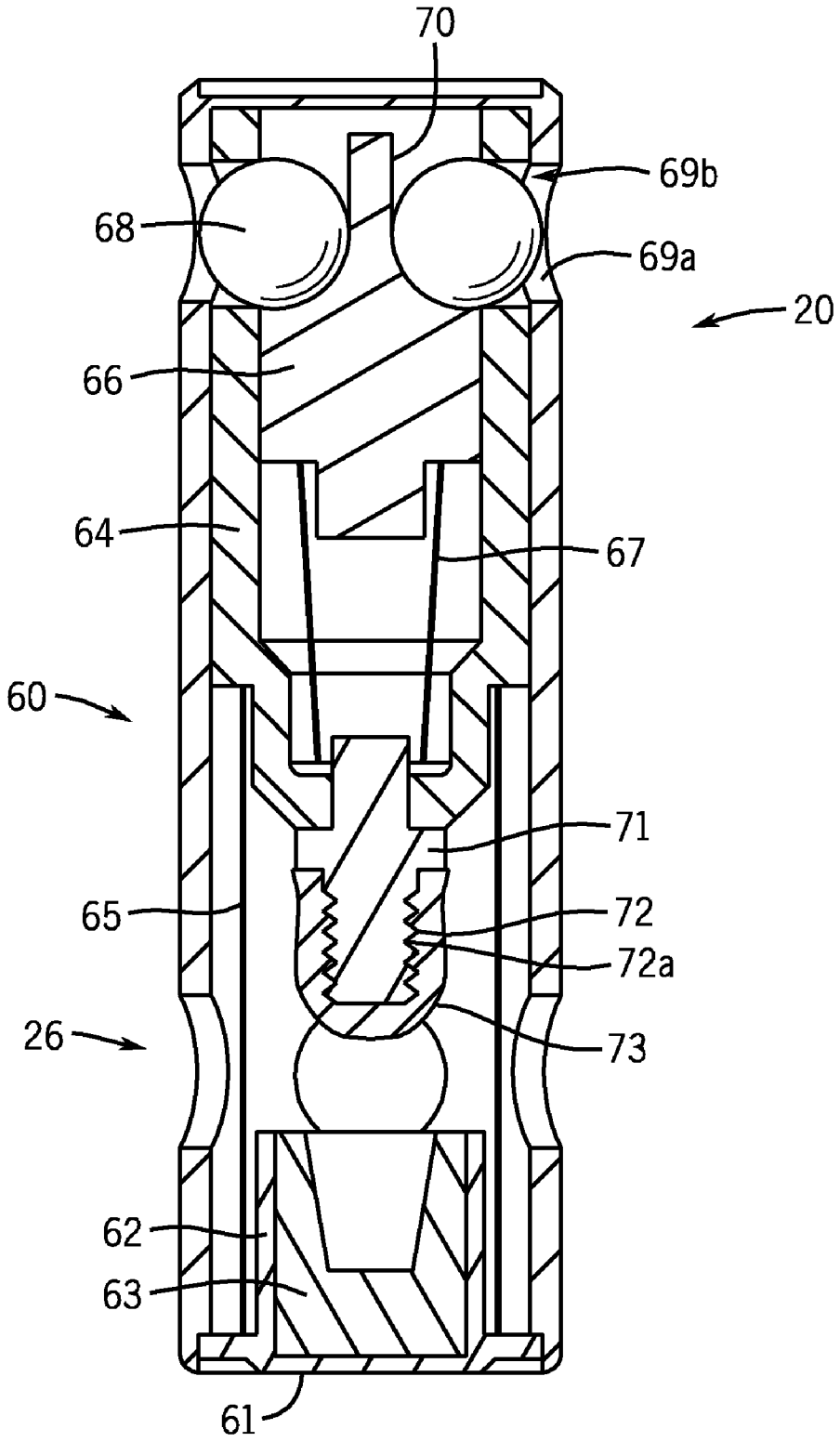
FIG. 2 (PRIOR ART)
FIG. 2 illustrates a schematic of a cross-section of an inertial igniter of the prior art
Figure 3:
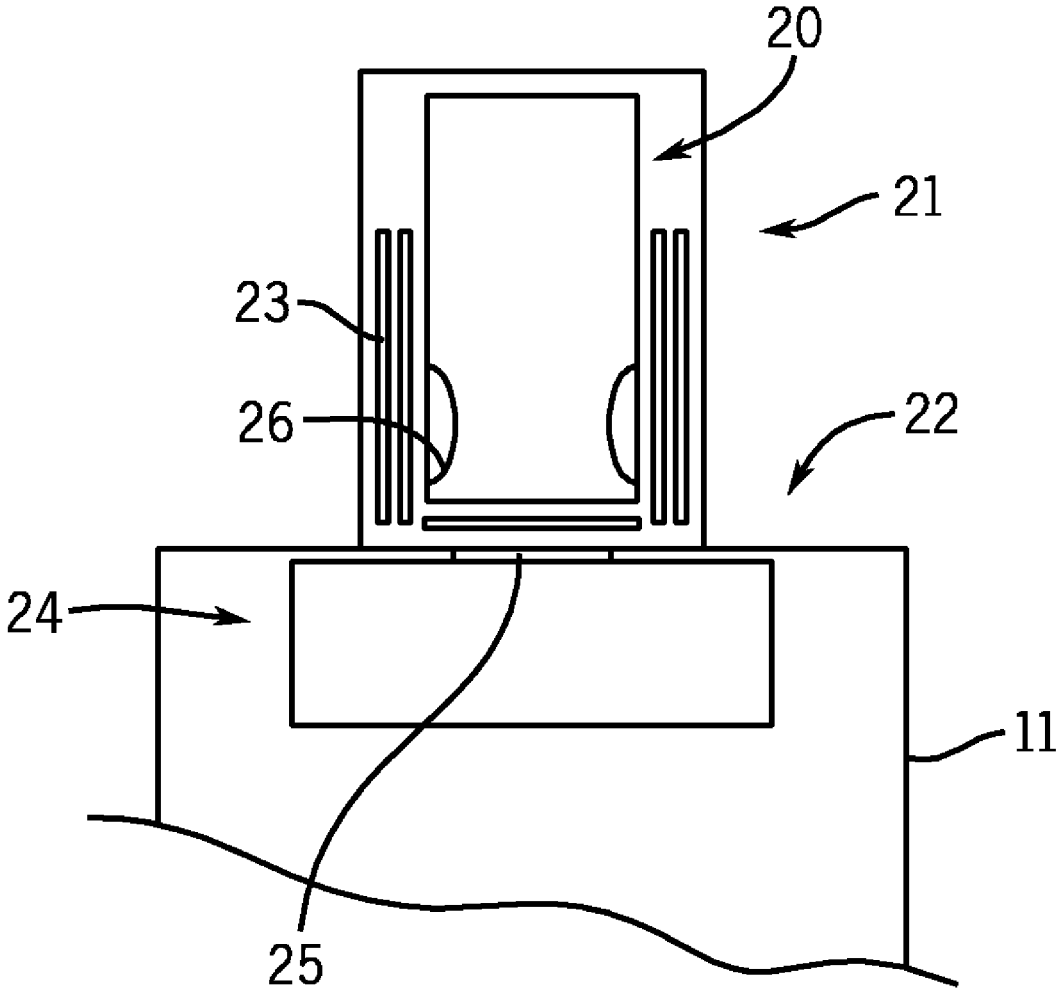
FIG. 3 (PRIOR ART)
FIG. 3 illustrates a partial schematic of the thermal battery and inertial igniter assembly of the prior art with the inertial igniter of FIG. 2 disposed therein.

As previously described, the safety mechanisms can be thought of as a time delay mechanism, after which a separate initiation system is actuated or released to provide ignition of the igniter pyrotechnics. In the designs of FIGS. 2 and 4, purely mechanical safety delay mechanism are used that operate based on the total length of travel of certain inertial elements (inertial element 66 in the device of FIG. 2 and the inertial element 46 in the device of FIG. 4), and the corresponding total amount of travel time of the said inertial elements that operate or release the ignition mechanism. To base a delay mechanism on the travel (translational, rotational or their combination) of a single inertial element is tantamount to limiting the axial compactness achievable because of the necessary and significant stroke length required to achieve the requisite delay timing.

Figure 5A:
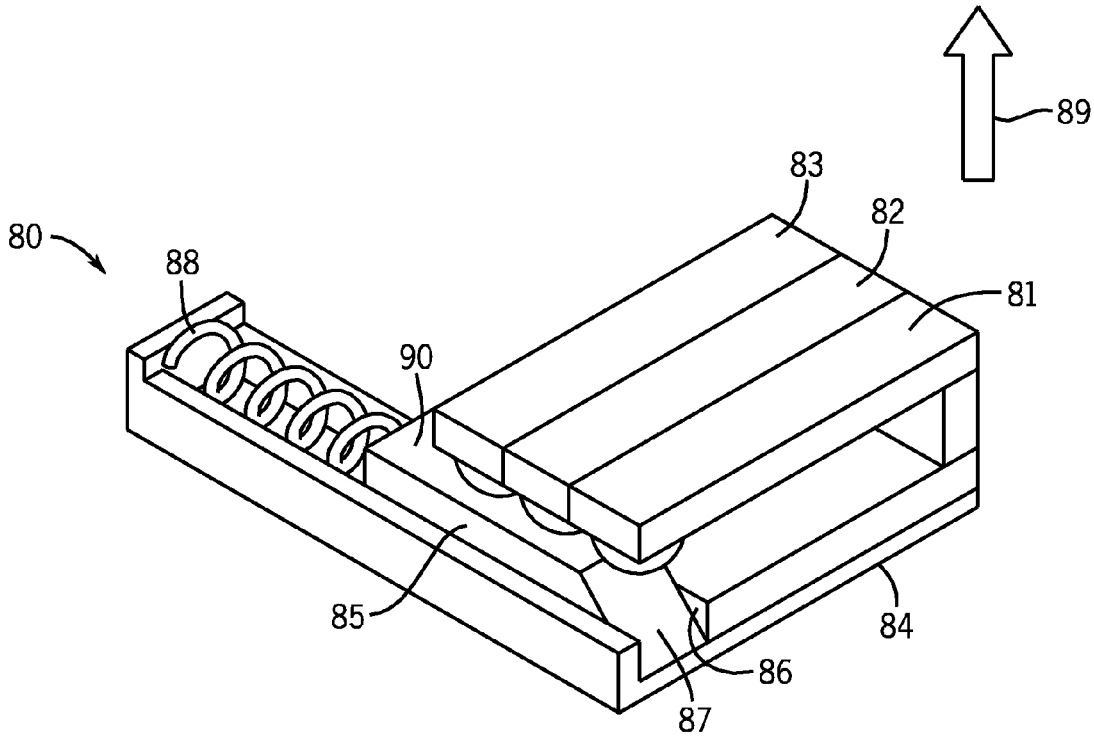
FIG. 5*a* illustrates an isometric view of an embodiment of a multi-stage mechanical delay mechanism.

The novel method to achieve highly compact and long delay time mechanisms for miniature inertial igniters for thermal batteries and the like may be best described by the following "finger-driven wedge design," which is a multi-stage mechanical delay mechanism embodiment and its basic operation. The schematic of such a three-stage embodiment 80 is shown in FIG. 5*a*. The device 80 can obviously be designed with as many fingers (stages) as is required to accommodate any delay time requirement and no-fire specifications commonly seen in gun-fired munitions or the like. The mechanism generally has three fingers (stages) 81, 82 and 83, each of which provides a specified amount of delay when subjected to a certain amount of acceleration (in the vertical direction of the arrow 89 as viewed in FIG. 5*a*). The fingers are fixed to the mechanism base 84 on one end. Each finger is provided with certain amount of mass and deflection resisting elasticity (in this case in bending). Certain amount of upward preloading may also be provided to delay finger deflection until a desired acceleration level is reached. When at rest, only the first finger 81 is resting on the sloped surface 87 of the delay wedge 85. The delay wedge 85 is preferably provided with a resisting spring 88 to bring the system back to its rest position, if the applied acceleration profile is within the no-fire regime of the inertial igniter and to offer more programmability for the device. The delay wedge 85 is positioned in a guide 86 which restricts the delay wedge's 85 motion along the guide 86.

The operation of the device 80 is as follows. At rest, the delay wedge 85 is biased to the right by the delay wedge spring 88, and the three fingers 81, 82 and 83 are biased upwards with some pre-load. The ratio of pre-load to effective finger mass will determine the acceleration threshold below which there will be no relative movement between components. The positions of the three fingers 81, 82 and 83 are such that finger 81 is above the sloped surface 87 of the delay wedge 85 and fingers 82 and 83 are supported by the top surface 90 of the delay wedge 85, and are prevented from moving until the delay wedge 85 has advanced the prescribed distance. This is illustrated in FIG. 5*a*.

If the device 80 experiences an acceleration in the direction 89 above the threshold determined by the ratio of initial resistances (elastic pre-loads) to effective component masses, the primary finger 81 will act against the sloped surface 87 of the delay wedge 85, advancing the delay wedge 85 to the left.

Figure 5B:
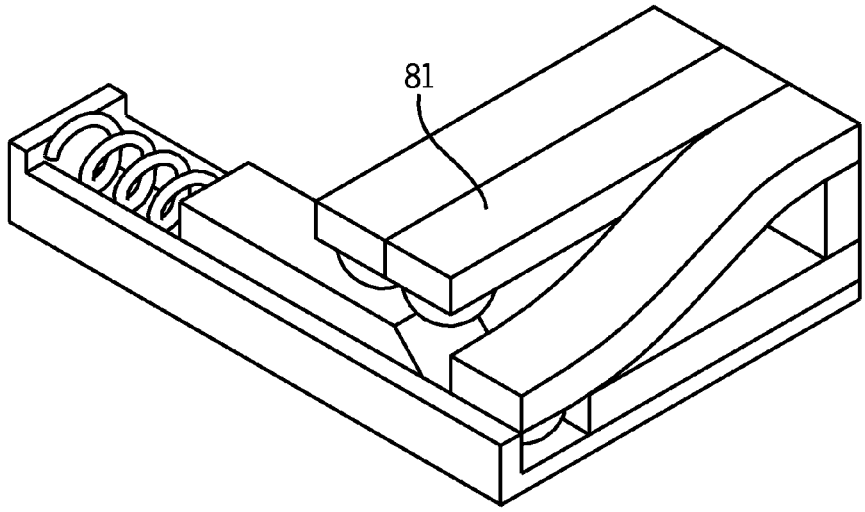
FIGS. 5*b*-5*d* illustrate the multi-stage mechanical delay mechanism of FIG. 5*a* in various stages of acceleration.

FIG. 5*b* shows the first finger 81 fully actuated and the delay wedge 85 advanced one-third of its total finger-actuated travel distance. At this instant, the second finger 82 is no longer supported by the top surface 90 of the delay wedge 85 and is free to move downwards provided that the acceleration is still sufficiently high to overcome the preload for the second finger 82 and the delay wedge spring 88 force at the aforementioned one-third travel distance.

Figure 5C:
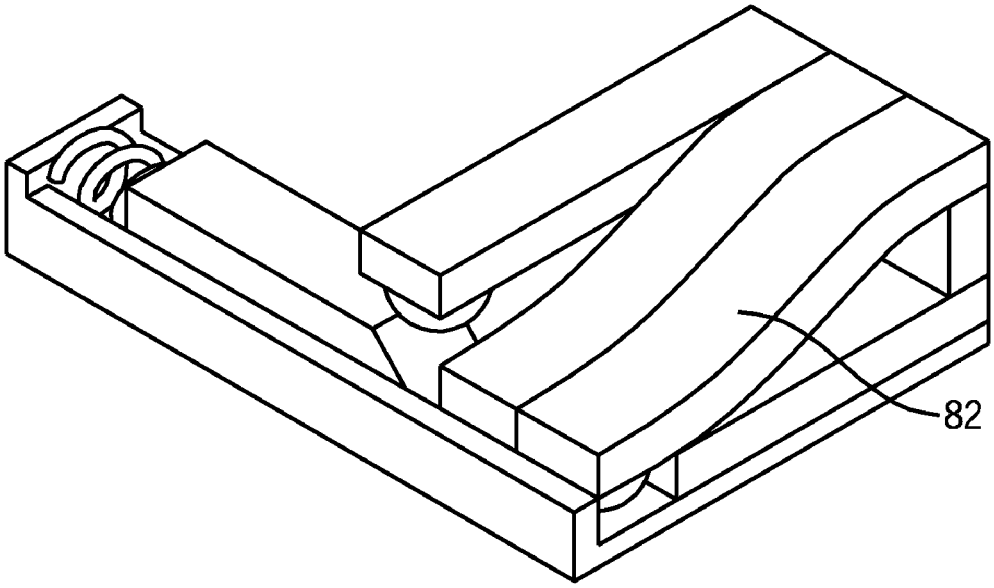

If the acceleration continues at an all-fire profile, the second finger 85 will drive the delay wedge to two-thirds of its total finger-actuated travel distance, allowing the third finger 83 to act on the top surface 90 of the delay wedge 85. This is shown in FIG. 5*c*.

If the acceleration terminates or falls below the all-fire requirements, the mechanism will reverse until balance is achieved between the acceleration reaction forces and the elastic resistances. This may be a partial or complete reset from which the mechanism may be re-advanced if an all-fire profile is applied or resumed.

Figure 5D:
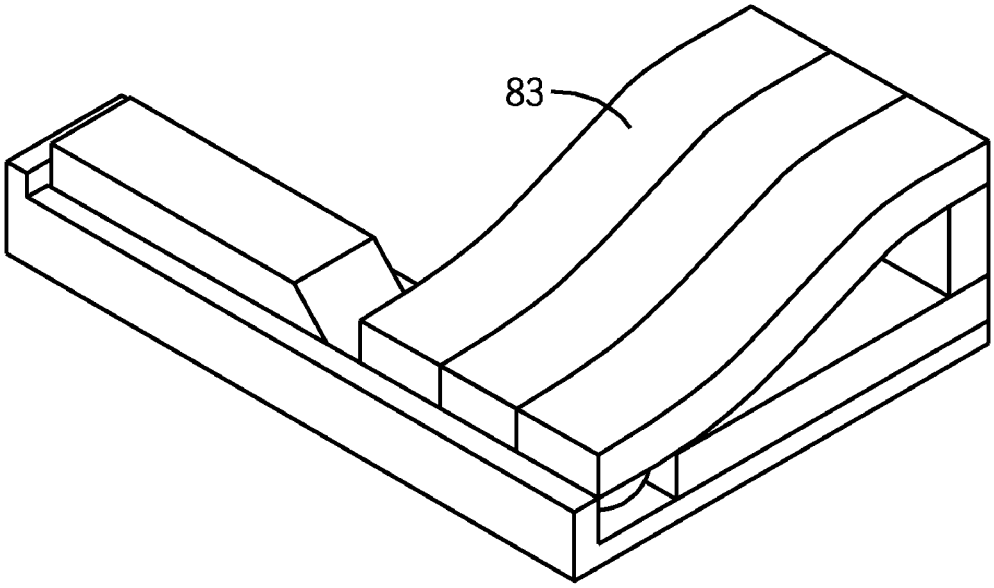

Full actuation of the mechanism will occur once all three fingers 81, 82 and 83 have driven the delay wedge 85 to its full travel in succession. This non-linear progression will be carried out as a continuation of the partial actuations described above. The full actuation of such a mechanism is shown in FIG. 5*d*.

Obviously, the amount of preloading and/or resistance to bending of the fingers 81, 82, 83 vary such that the first finger 81 bends under a certain acceleration profile, finger 82 bends under a larger acceleration profile than the first finger 81 and the third finger 83 bends under the largest acceleration profile. Furthermore, the delay wedge 85 can be configured to provide the ignition of the thermal battery upon full activation.

The above multi-stage mechanical delay mechanism 80 may obviously be configured in a wide variety of configurations with the common characteristics of providing the means for sequential travel of two or more inertial elements under an applied acceleration. This novel method of providing a mechanical time delay mechanism via sequential travel of inertial elements provides devices that occupy very short heights while achieving very long time delays. The significance of the multi-stage design in reducing the height of the mechanical time delay mechanisms, thereby the size (particularly the height) of inertial igniters can be described as follows.

Figure 6:
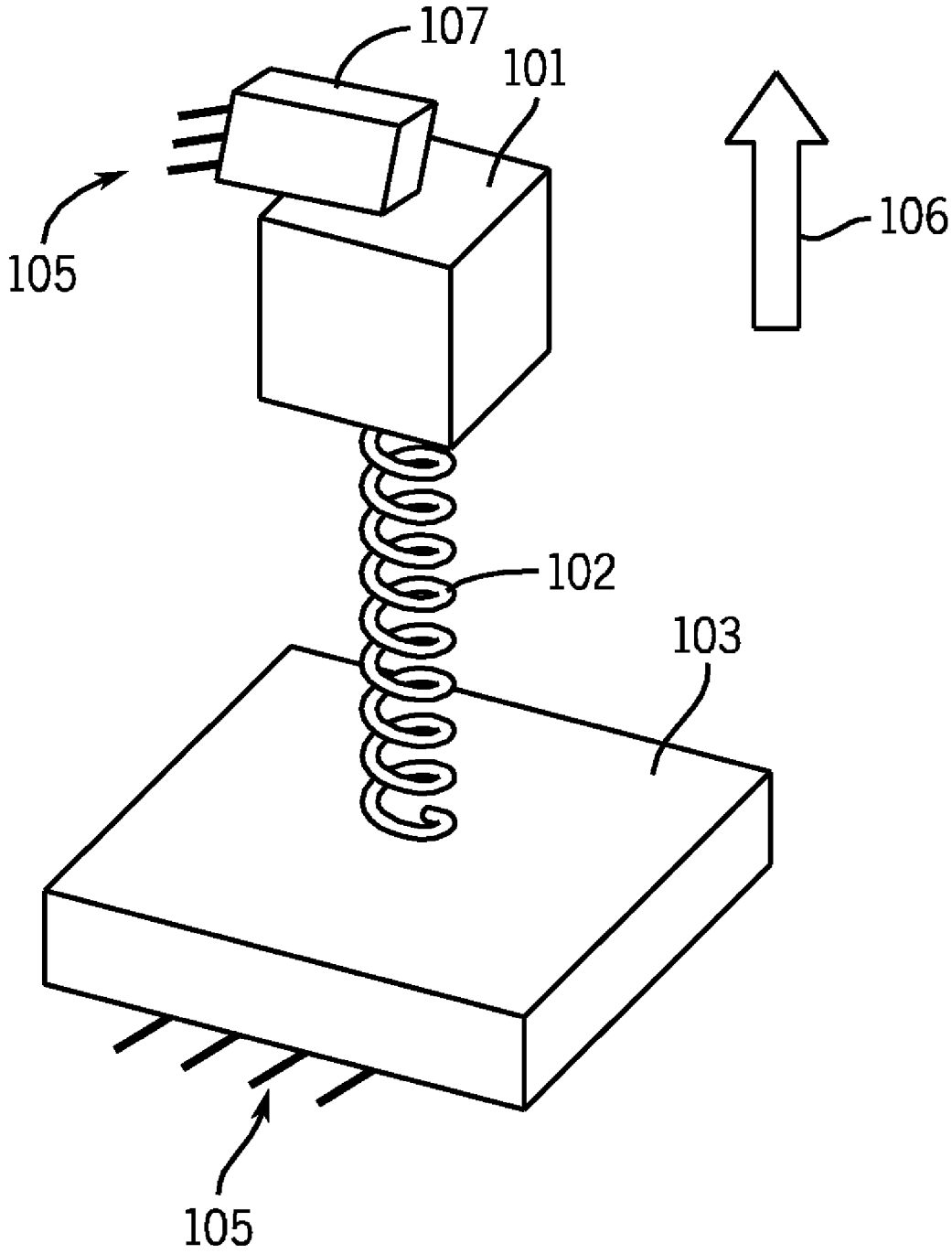
FIG. 6 illustrates an expansion constrained mass-spring model for evaluating delay time as a function of total vertical distance that the inertial (mass) element(s) of the various mechanical delay mechanisms have to travel due to the vertical travel distance of the inertial elements of the igniter.

The mathematical model that can be used to evaluate the delay time as a function of the total vertical distance that the inertial (mass) element(s) of the various mechanical delay mechanisms have to travel due to the vertical travel distance of the inertial elements of the igniter, i.e., the minimum height of the device and thereby the resulting inertial igniter, is based on an expansion constrained mass-spring model as shown in FIG. 6, consisting of a mass (inertia) element 101 and spring element 102. The spring element 102 is attached to the base 103, which in turn is fixed to the accelerating platform 105. The spring element 102 is preloaded in compression, and is constrained to expand from its preloaded position shown in FIG. 6 by the stop 107, which is fixed to the accelerating platform 105.

When the base is accelerated upwards in the direction of the arrow 106, the mass 101 will experience a reaction force downward. Since the spring 102 is preloaded in compression, a threshold will exist below which the reaction force on the mass will not be high enough to deflect the spring from its preloaded position. Beyond this acceleration threshold, the mass 101 will move downward. For relatively high preloads and relatively small spring 102 deflections (such as those employed in the described miniature inertia igniters) the spring 102 force can be assumed to be constant throughout the deflection. The net force on the mass is then equal to the difference between the reaction force from the acceleration and the constant spring force.

To generate a generic model applicable to a system without a predetermined mass or spring rate, the preload force may be expressed in terms of a force equivalent to the supported mass under some acceleration $$F_p = mA_p g$$

where $F_p$ is the preload force, $A_p$ is the equivalent preload acceleration magnitude in G's, and g is the gravitational acceleration constant. This acceleration, $A_p$, may now be subtracted from the acceleration which is producing the reaction force on the mass 101. In other words, we specify the preload not in terms of force, but in terms of the threshold of acceleration below which there will be no spring 102 deflection. If the net equivalent acceleration on the mass 101 in G's is A, the displacement of the mass 101, i.e., the deflection of the spring 102, y, as a function of time t, can be expressed as $$y = 1/2Agt^2 \quad (1)$$

Figure 7:
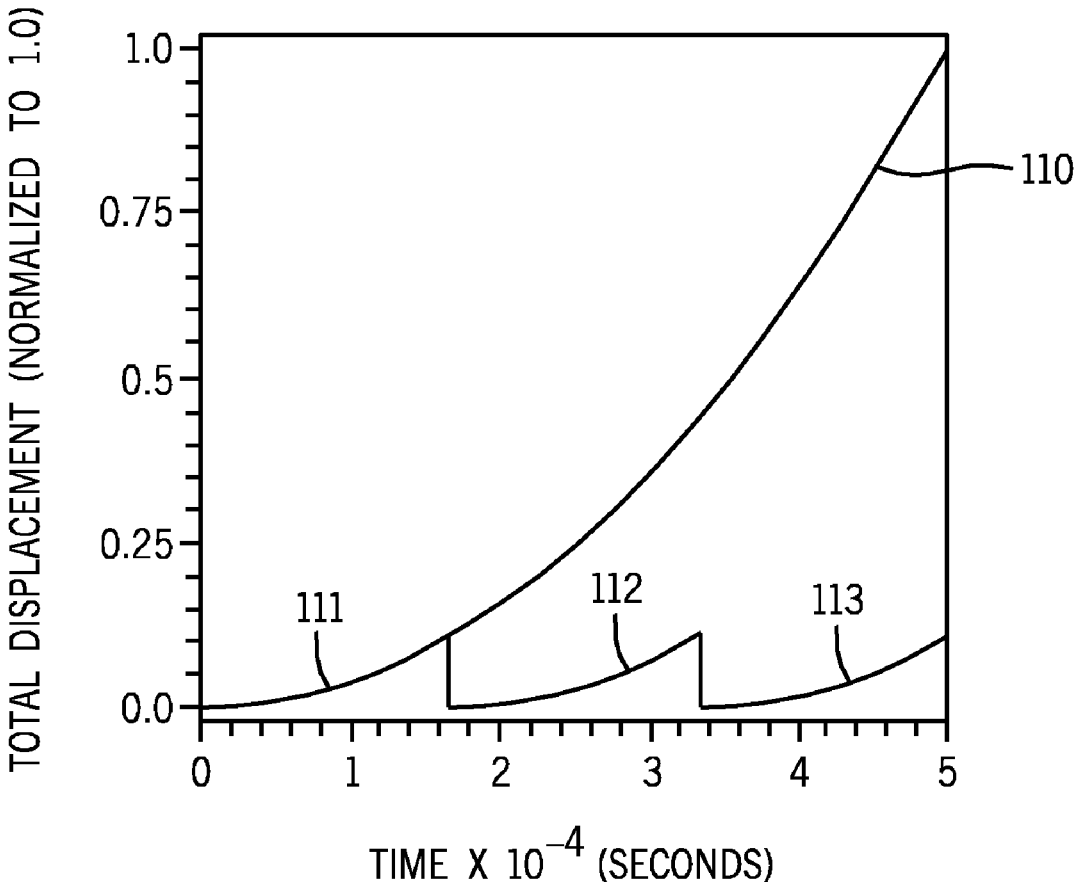
FIG. 7 illustrates a plot of the expansion constrained mass-spring model of FIG. 6 where a 2000 G pulse is applied to the base for 0.5 millisecond duration.

Now, from the equation (1) we can compare the necessary axial displacement of the inertial elements (mass 101 in the model of FIG. 6) in a single stage mechanical delay mechanism with the axial displacement of the inertial elements (mass 101 in the model of FIG. 6) in a multi-stage mechanical delay mechanism. In the plot of FIG. 7, a 2000 G pulse is considered to be applied to the base 103 in the direction of the arrow 106 for 0.5 millisecond duration. The mass elements 101 in both mechanical delay mechanisms are supported by constant-force springs 102 with preload forces equivalent to a movement threshold of 700 G. The vertical displacement of the mass (inertial) elements 101 have been scaled such that the displacement of the mass 101 in the single-stage mechanical delay mechanism (indicated by the curve 110 in the plot of FIG. 7) at the end of the aforementioned acceleration pulse has a magnitude of one. Considering a three-stage mechanical delay mechanism, the vertical displacement of the first, second and third mass elements 101 of the first, second and third stages are shown in FIG. 7 by the curves 111, 112 and 113, respectively. The total vertical displacement required for the three stages (in fact for any number of stages) of a multi-stage mechanical delay mechanism is seen to be limited to the displacement of one of its stages alone. From the plot, the advantage of the three-stage design is clear: the total vertical displacement of a three-stage design nearly 90% smaller than that of the single-stage (currently available) designs.

It is noted that the reason behind a significant advantage of the disclosed multi-stage inertial mechanical delay mechanisms is the fact that for a single mass subjected to an acceleration, the resulting displacement is a quadratic function of the time of travel, equation (1) above. A quadratic function, curve 110 in FIG. 7, is more or less flat at the beginning, i.e., during the first relatively small intervals of time the displacement is small since the inertial element 101 has not gained a considerable amount of velocity. The present multi-stage inertial igniters take advantage of this characteristic of the aforementioned quadratic delay time vs. displacement relationship, equation (1), by limiting the total (vertical) displacement of the inertial elements 101 of each individual stage, thereby achieving very small vertical height requirement.

The mechanical delay mechanisms, such as the one shown schematically in FIG. 5, provide a high degree of design flexibility and programmability with the following parameters that can be used to tune the device for performance to meet requirements in a broad range of applications:

Delay wedge interface angle

Delay wedge resistance spring rate

Delay wedge pre-load force

Delay wedge mass

The effective mass of each finger may be prescribed individually.

The spring rate of each finger may be prescribed individually.

The pre-load force of each finger may be prescribed individually.

The number of drive fingers (stages) in the design.

The distance through which fingers displace to advance the delay wedge.

The mechanical delay mechanisms developed based on the disclosed novel method may be applied in a variety of embodiments to a large number of initiation systems such as to inertial igniters through a plurality of locking mechanisms. Several of such embodiments and their combinations are described herein.

It is noted that the present method and the resulting mechanical delay mechanisms do not rely on dry friction or viscous or any other type of damping elements to achieve time delay. This is a significant advantage of the present novel method and the resulting mechanical delay mechanisms since friction and damping forces, particularly friction forces, are highly unpredictable or require velocity gain (large displacements) for effectiveness. In addition, the characteristics of friction and damping elements generally change with time, thereby resulting in relatively short shelf life for such devices.

However, if shelf life and/or performance precision are not an issue, friction and/or viscous damping element(s) of some kind may be used together with the spring elements (preferably in parallel with the spring elements 102, FIG. 6, not shown) in one or more stages of the mechanical delay mechanism to slow down the motion of one inertial elements. The dry friction elements (such as braking elements) are well known in the art. Viscous damping elements operating based on fluid or gaseous flow through orifices of some kind or a number of other designs using the fluid or gas viscosity, or the use of viscoelastic (elastomers and polymers of various kind and designs) are also well known in the art.

However, the use of any of the aforementioned viscous damping elements has several practical problems for use in inertial igniters for thermal batteries that are to be used in munitions. Firstly, to generate a significant amount of damping force to oppose the acceleration generated forces, the inertial element must have gained a significant amount of velocity since damping force is proportional to the attained velocity of the inertial element. This means that the element must have traveled long enough time and distance to attain a high enough velocity, thereby resulting in too long igniters. Secondly, fluid or gaseous based damping elements and viscoelastic elements that could be used to provide enough damping to achieve a significant amount of delay time cannot usually provide the desired shelf life of up to 20 years as required for most munitions.

Figure 8A:
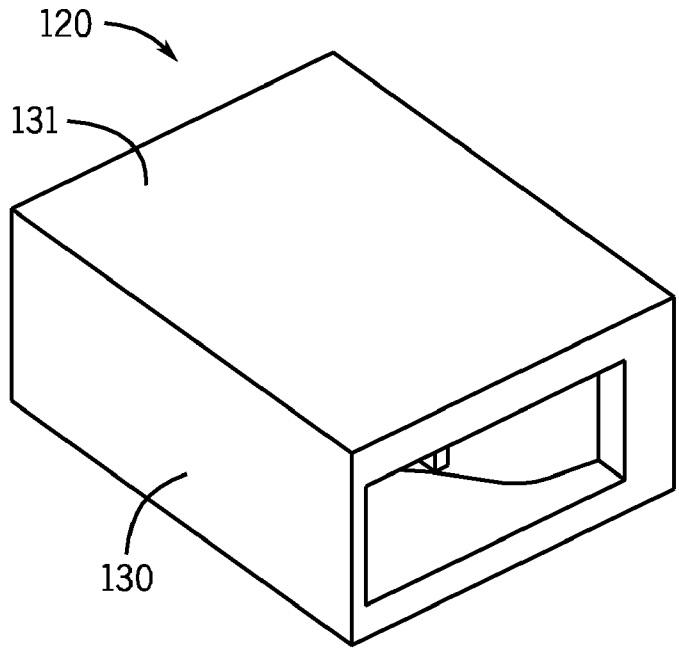
FIGS. 8*a* and 8*b* illustrate an isometric view of another embodiment of a multi-stage mechanical delay mechanism with FIG. 8*b* being illustrated without its housing.
Figure 8B:
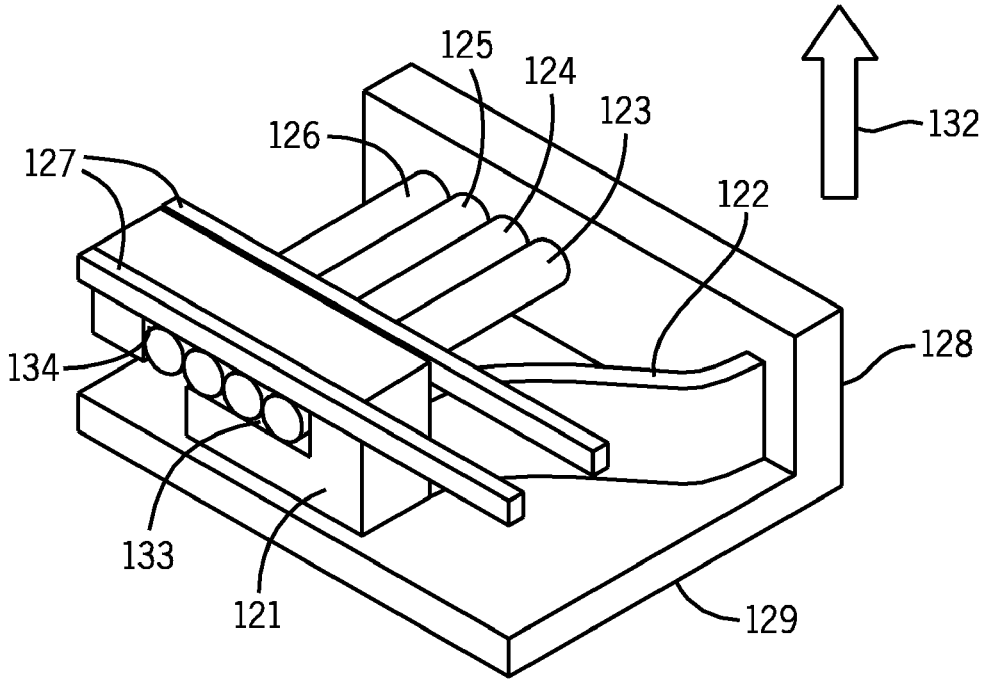

The schematic of another embodiment 120 of the present invention is shown in FIG. 8*a*. In FIG. 8*b*, the housing 130 of the mechanical delay mechanism 120 is removed to show its internal components. In this embodiment, a closed-profile carriage element 121 is used instead of an open profile delay wedge 85 of the embodiment of FIG. 5. The closed-profile carriage element 121 is constrained to longitudinal translation between the guides 127 and the bottom wall 129 and top wall 131 of the housing 130 of the mechanical delay mechanism 120. The closed-profile carriage element 121 provides an anti-back-drive multi-stage mechanical delay mechanism that operates in a manner similar to the embodiment of FIG. 5. With the provision of the closed-profile carriage element 121, the engaging fingers (stages), 123 and 124 and 125 and 126 in FIG. 8*b*, prevent the closed-profile carriage element 121 to translate along its longitudinal guides 127 if subjected to acceleration in the said direction. This characteristic of this mechanical delay mechanism allows it to withstand high centripetal accelerations experienced by spin-stabilized projectiles, and not to activate by not allowing the closed-profile carriage element 121 to displace under such longitudinal accelerations.

The fingers 123, 124, 125 and 126 are fixed on one end to the wall 128 of the housing 130. A spring element 122 (shown as a bending beam type of spring), attached on one end to the wall 128 of the housing 130 and on the other end to the closed-profile carriage element 121, which is preferably preloaded, is used to bias the closed-profile carriage element 121 against the last finger 123 to the right.

Figure 8C:
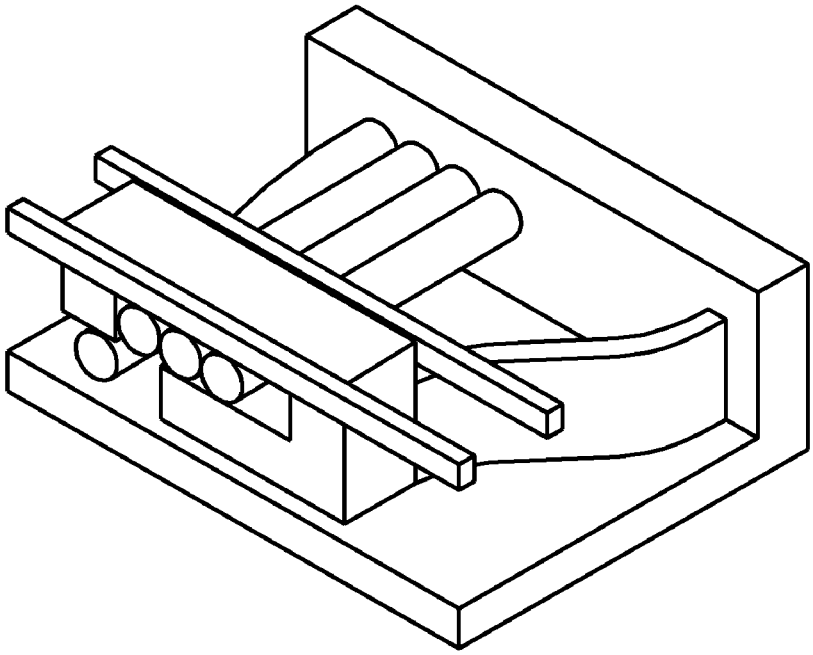
FIGS. 8*c*-8*f* illustrate the multi-stage mechanical delay mechanism of FIGS. 8 and 8*a* in various stages of acceleration.

When subjected to acceleration in the direction of the arrow 132, the mechanical delay mechanism 120 will operate as follows: At rest, the mechanical delay mechanism 120 is configured as shown in FIG. 8*b*, with all four delay fingers 123, 124, 125 and 126 pre-loaded upwards inside the closed-profile carriage element 121. The lateral stiffness of the delay fingers prevents the bending drive spring 122 from displacing the closed-profile carriage element 121. Upon experiencing an acceleration great enough to overcome the preload of the first bending finger 126, this first finger will begin to move downwards out of the closed-profile carriage element 121. All other fingers 125, 123 and 123 are prevented from displacing vertically by the closed-profile carriage element 121 floor 133. Once the first (stage) finger 126 has exited the carriage 121, the bending drive spring 122 will advance the carriage 121 until the second (stage) bending finger 125 contacts the carriage 122 face 134. The carriage 121 will now come to rest. The result of this first-stage actuation is shown in FIG. 8*c*.

Figure 8D:
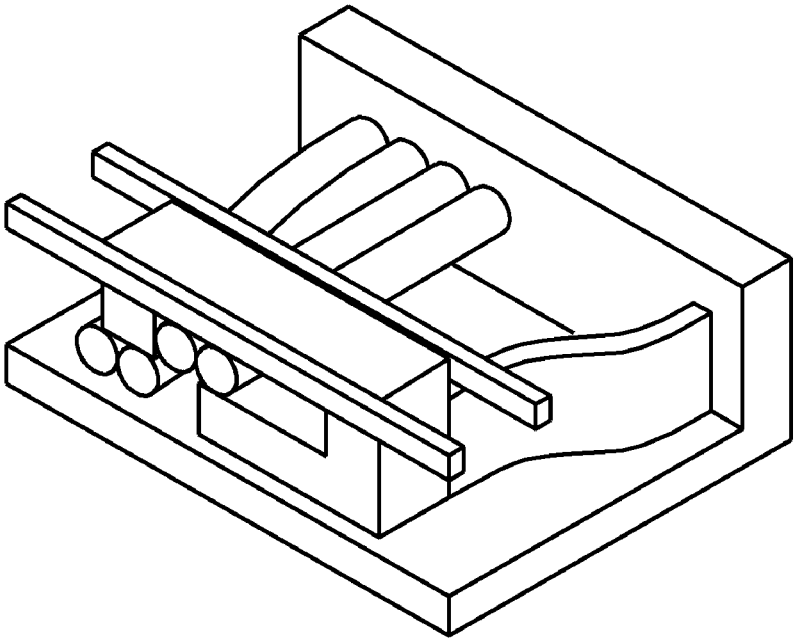
Figure 8E:
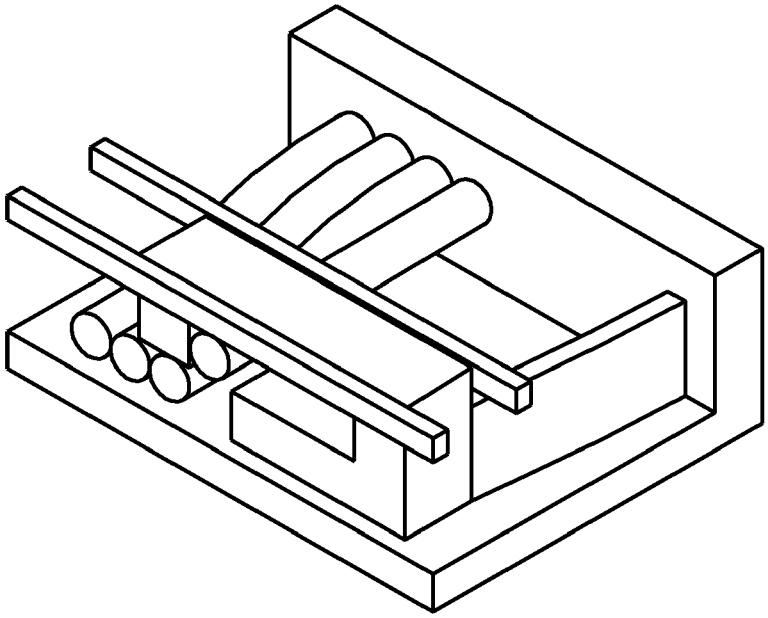
Figure 8F:
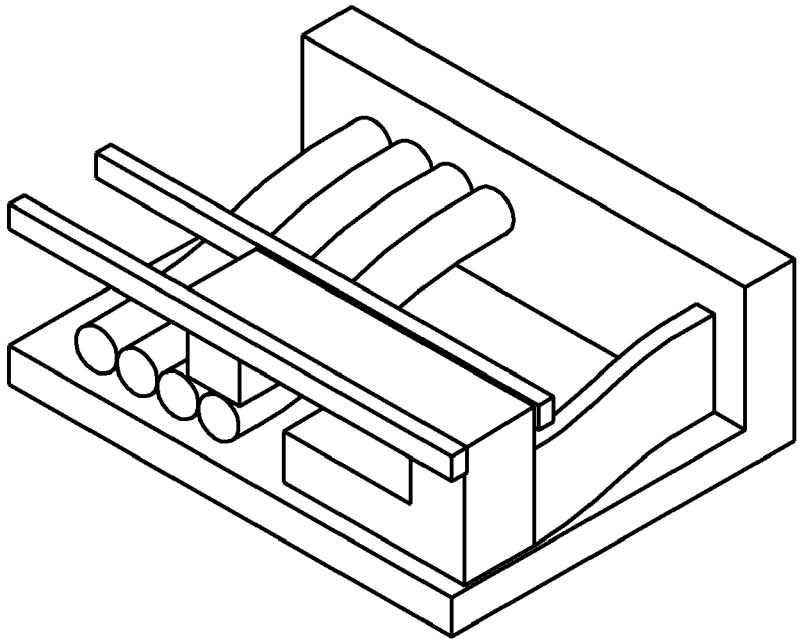

Now that the second finger 125 is no longer supported by the carriage floor 133, if the acceleration is great enough to overcome the preload of the second finger 125, this finger will begin to move down in a manner similar to the finger 126 in the first stage. The result of this and subsequent stages are shown in FIGS. 8*d-f*.

As can be observed, the mechanical delay mechanism 120 makes use of multiple stages and lateral displacement of the carriage 121 to control the delay characteristics (this leads to great vertical compactness), but is not sensitive to lateral forces which may back-drive the carriage 121.

Figure 9A:
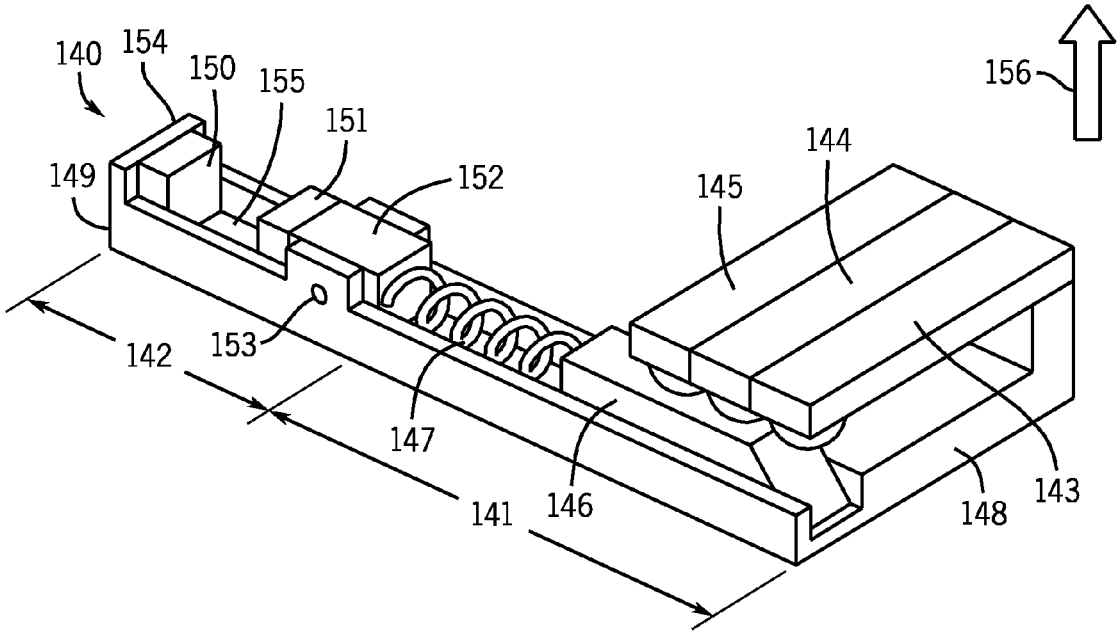
FIG. 9*a* illustrates an isometric view of an embodiment of an inertia igniter including the multi-stage mechanical delay mechanism striker of FIG. 5*a* configured to initiate pyrotechnic materials.

As previously stated, any one of the multi-stage mechanical delay mechanisms developed using the present novel method, such as those of the embodiments shown in FIGS. 5 and 8, can be readily mated with an appropriate striker mechanism to initiate the pyrotechnic materials of the resulting inertial igniter. The schematic of one embodiment 140 of such an inertial igniter is shown in FIG. 9*a*. In this embodiment 140, the mechanical delay mechanism 80 illustrated in FIGS. 5*a*-5*d* is indicated as segment 141 of the inertial igniter 140, is used with an attached striker portion, indicated as 142. The multi-stage mechanical delay mechanism shown has three stages with three fingers 143, 144 and 145, a delay wedge 146 and resisting spring 147, all mounted on the base structure 148 and operating as described for the embodiment of FIG. 5. The striker portion 142 consists of an extension 149 of the base structure 148 of the mechanical delay mechanism; and a striker mass 152, which when free could traverse the guide 155, and is normally attached to the sides of the guide 155 with an appropriately sized shear pin 153. In the schematic of FIG. 9*a*, two part pyrotechnic components 151 and 150 are shown to be attached to the striker mass 152 and the end piece 154 of the base structure 149. If a one piece pyrotechnic element or a percussion primer is used, they are preferably attached to the end piece 154 with the initiation pin (if necessary) attached to the striker mass 152.

Figure 9B:
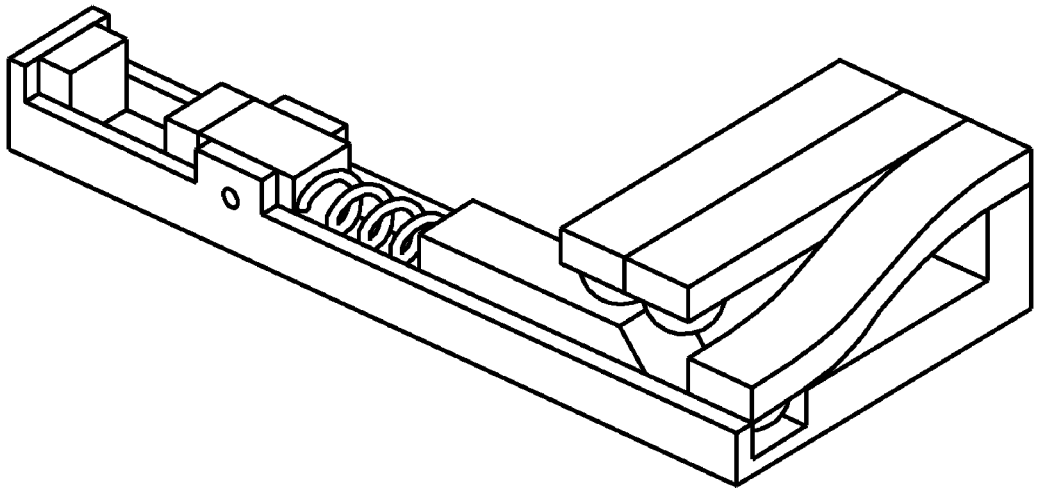
FIGS. 9*b*-9*e* illustrate the inertia igniter of FIG. 9*a* in various stages of acceleration.
Figure 9C:
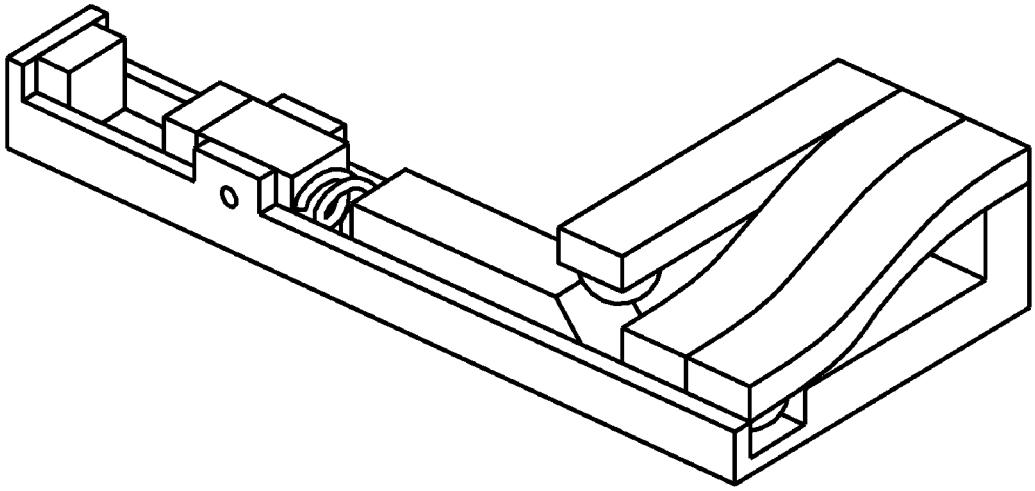
Figure 9D:
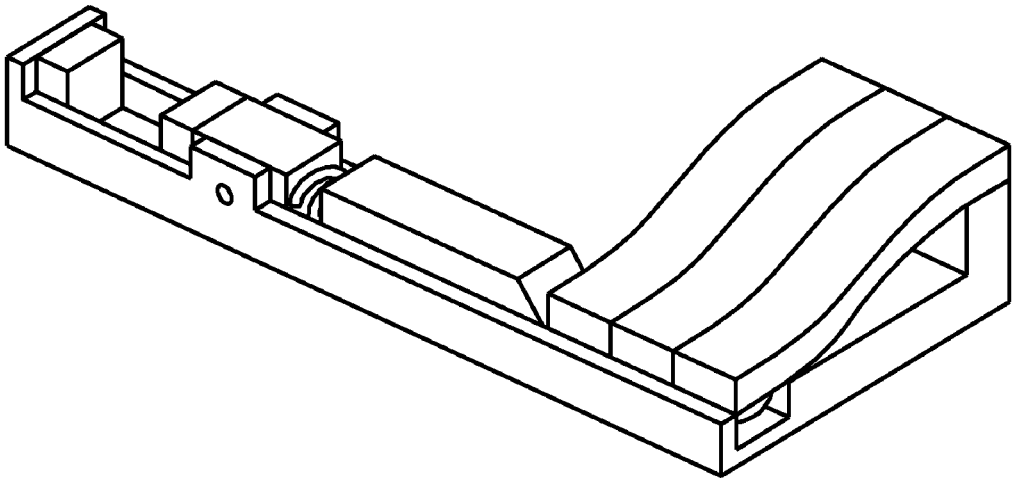
Figure 9E:
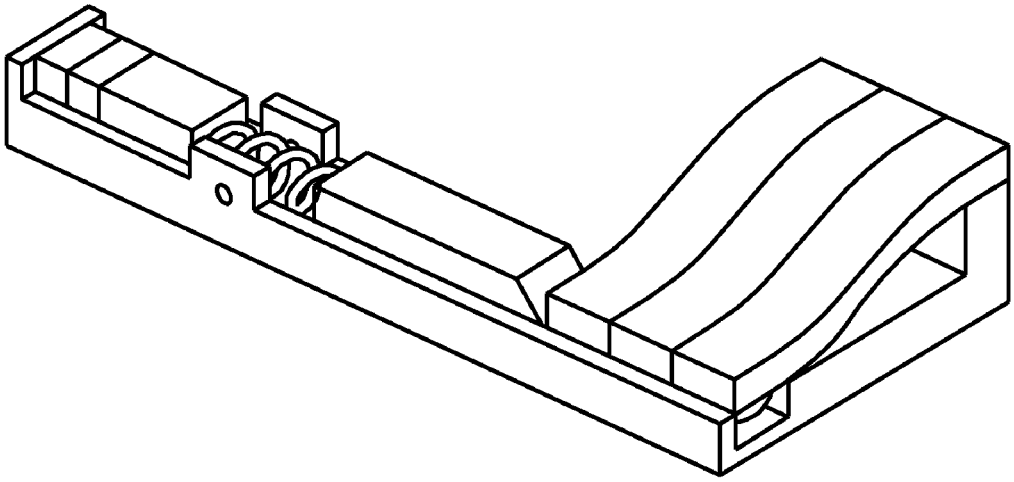

The operation of the mechanical delay portion 141 is identical to that of the embodiment of FIG. 5. In this embodiment, however, the spring element 147, which resists the progression of the delay wedge 146, serves also as the spring for the striker mass 152. In FIG. 9*a* the inertial igniter 140 is shown at rest. The direction of the acceleration that the inertial igniter is subjected to during the munitions firing is shown by the arrow 156. The operation of the striker system is described as follows. In the event of an all-fire acceleration profile, the delay wedge 146 is driven to the left first by the first stage finger 143, then by the second stage finger 144 and then by the third stage finger 145, while potential energy is being stored in the spring element 147 due to its compression as shown sequentially in FIGS. 9*b-d*. The device can be designed such that the shear pin 153 (or other anchoring element which is securing the striker mass 152 to the structure 149) will fail when the force developed in the spring element 147 is indicative of full actuation of the delay wedge 146. The fingers 143, 144 and 145, still under the influence of the all-fire acceleration profile, will keep the delay wedge 146 in place while the spring element 147 accelerates the striker mass 152 towards its target, causing the component 151 of the two component pyrotechnic to impact its second component 150, thereby initiating the pyrotechnic ignition. This initiation is shown in the FIG. 9*e*.

In an alternative embodiment of the present invention, instead of the pin 153, a stop mechanism such as a lever mechanism or a sliding stop mechanism (not shown) is used to prevent the striker mass 152 from moving to the right. Then as the third stage finger 145 is depressed and moves the delay wedge 146 towards its leftmost position, the delay wedge 146 actuates the aforementioned stop mechanism, thereby freeing the striker mass 152 to accelerate to the left and affect the initiation of the pyrotechnic element(s). Alternatively, the aforementioned stop mechanism is actuated by the last stage finger 145. Such mechanical stops that are actuated by the movement of a secondary element are well known in the art and are therefore not described in more detail herein.

One of the advantages of the above embodiment of the inertia igniter of FIG. 9*a* is its high degree of initiation safety in the sense that the spring element 147 that actuates the striker mass 152 is not preloaded while the device is at rest; therefore there is no possibility of accidental ignition. In addition, the device does not use dry friction or damping elements which are highly unpredictable or require velocity gain (large displacements) for effectiveness. The above advantages are in addition to the previously stated advantage of multi-stage mechanical delay mechanisms in significantly reducing the required size, particularly height, and volume of the resulting inertial ignited.

Figure 10A:
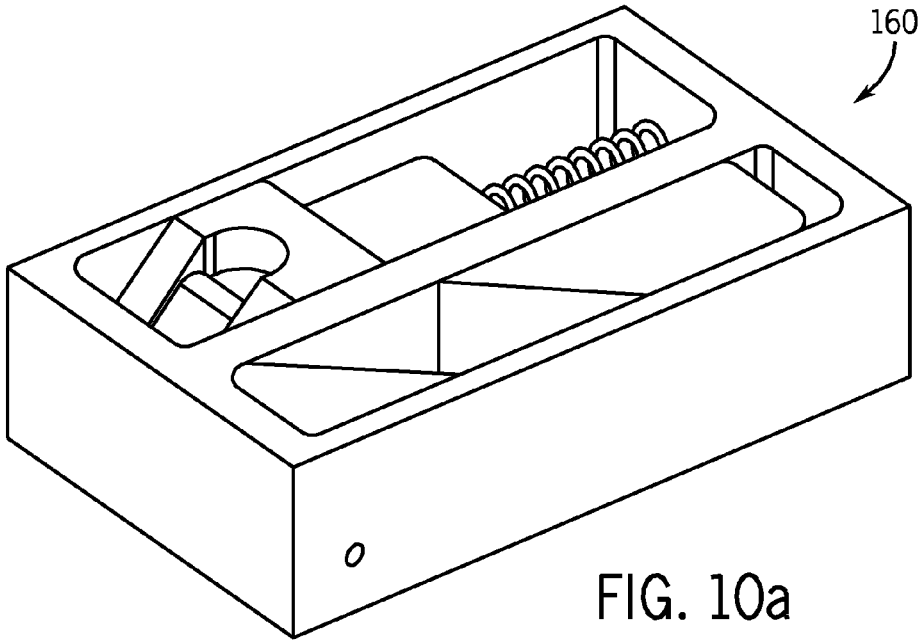
FIGS. 10*a* and 10*b* illustrate isometric views of another embodiment of an inertia igniter configured to initiate pyrotechnic materials, where
Figure 10B:
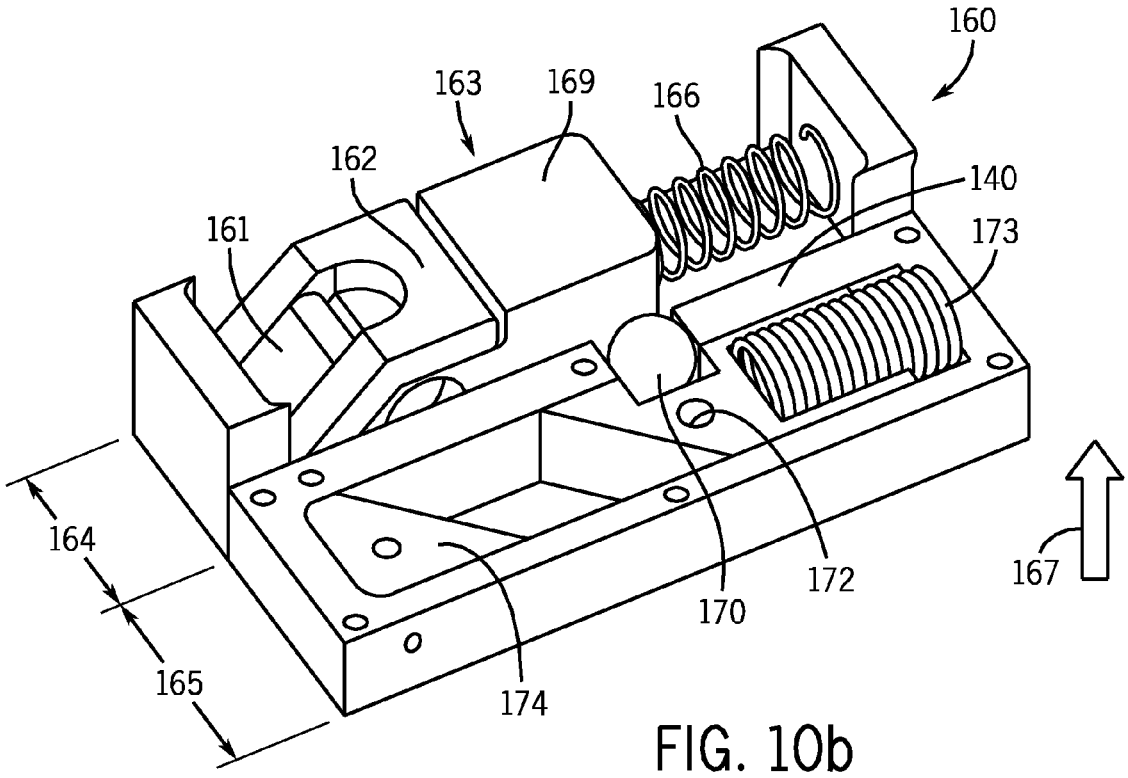
Figure 10C:
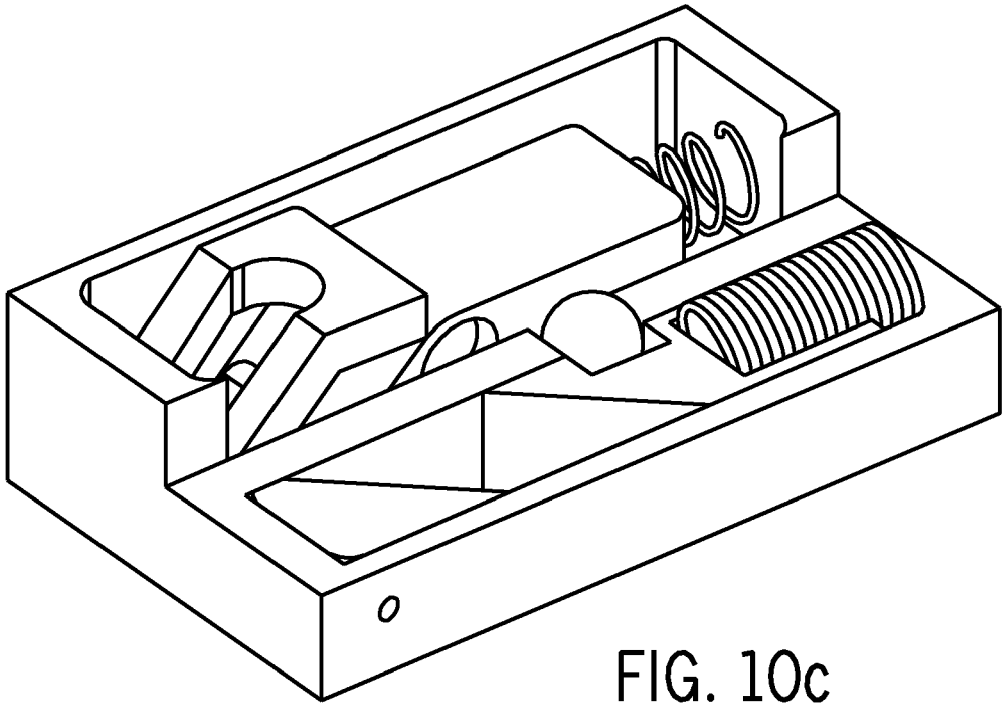
FIGS. 10*c*-10*e* illustrate the inertia igniter of FIG. 10*a* in various stages of acceleration.
Figure 10D:
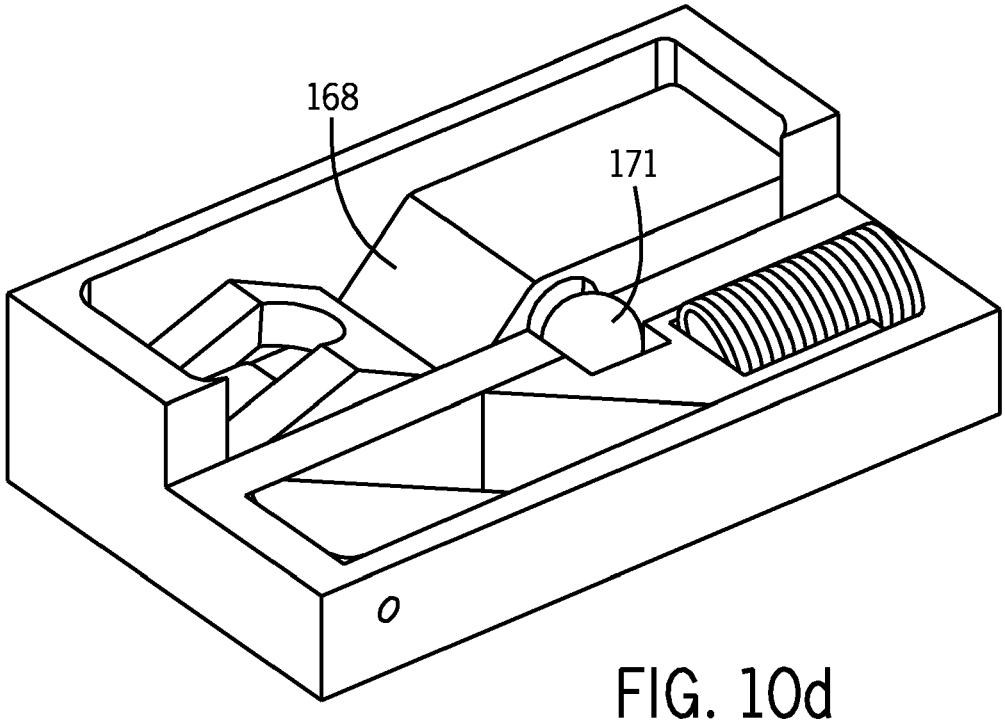
Figure 10E:
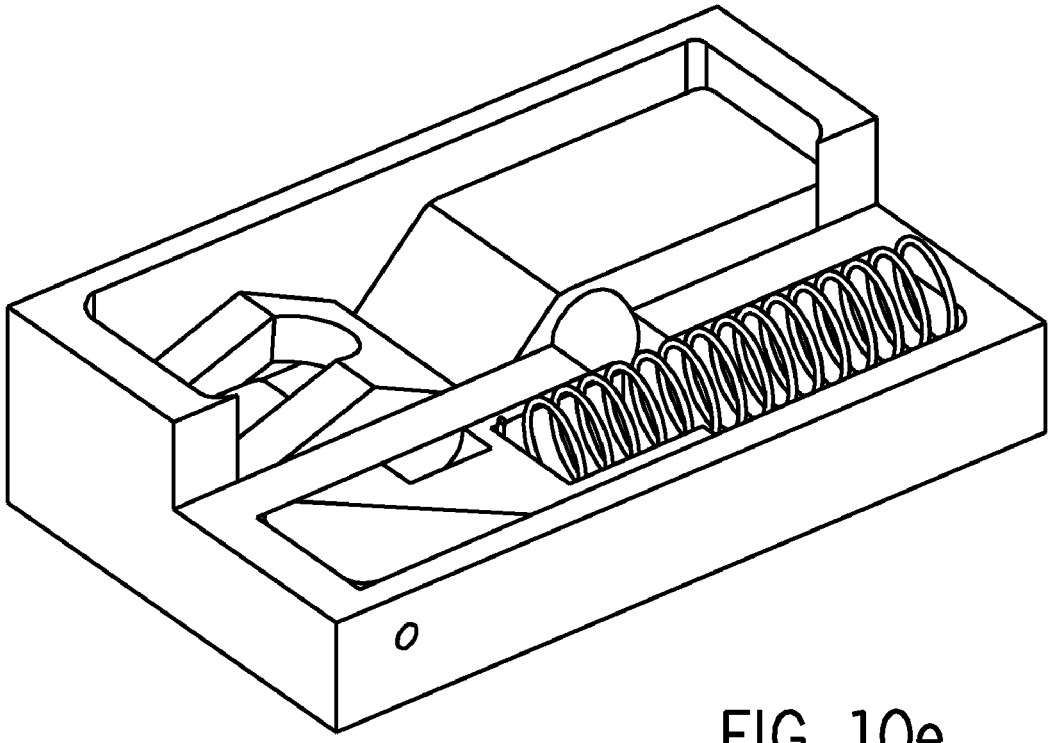

Another embodiment 160 is shown schematically in FIGS. 10*a*-10*e*. The inertial igniter 160 without a top cap is shown in FIG. 10*a*. Cutaway drawings of this device are used in the drawings 10*b*-10*e* to clearly show its internal components and its operation. The mechanical delay mechanism of the embodiment of FIG. 10*a* is a two-stage finger design, similar to the embodiment shown in FIG. 5, with a difference being that fingers 161 and 162 operate in a plane parallel to the direction of advancement of the delay wedge 163 during its motion. The fingers 161 and 162 are preferably flexural members to achieve a compact design. In this embodiment, a ball release mechanism is used to couple the mechanical delay mechanism component 164 to an adjacent pre-loaded striker system and its pyrotechnic component 165 as shown in FIG. 10*b*. The operation of this inertial igniter embodiment can be described as follows. At rest, the fingers 161 and 162 are preloaded upwards and the delay wedge 163 preloaded to the left by the spring 166. These preload forces and the effective mass of the fingers 161 and 162 and associated components establish an acceleration magnitude threshold below which no relative motion of these components may occur. The device at rest is shown in FIGS. 10*a* and 10*b*. Upon having a sufficient impulse imparted on the housing of the device in the direction of the arrow 167, the finger 161 will act against the sloped surface 168 (FIG. 10*c*) of the delay wedge 163 with a force caused by reaction to the acceleration of the projectile in the direction of the arrow 167. This resultant force will drive the delay wedge 163 to the right. If the acceleration profile is sufficient to fully depress the first finger 161, the delay wedge 163 will be driven half its full stroke, allowing the finger 162 to engage the sloped surface 168 of the delay wedge 163 rather than being supported by the top surface 169 of the delay wedge 163 as was previously the case. This is shown in FIG. 10*c*. In the case of an all-fire acceleration profile, the second finger 162 will also be driven fully downwards, fully advancing the delay wedge 163. This is shown in FIG. 10*d*. At this point, the ball 170 is pushed into a recess 171 provided on the side of the delay wedge 163, thereby releasing the striker 172, allowing the preloaded striker spring 173 to accelerate the striker 172 towards the element 174, causing their impact. By providing pyrotechnic materials (one or two part pyrotechnic elements) on either or both impacting surfaces (with pressure concentrating pins if necessary—not shown), the pyrotechnic material(s) is ignited. This is shown in FIG. 10*e*. In the case of partial actuation of the mechanical delay mechanism 164, the mechanism will fully reverse and reset, ready for future operation.

It is noted that a difference between the embodiments shown in FIGS. 5 and 10 is that in the embodiment of FIG. 5, the spring 147 which actuates the striker 152 is not preloaded. In contrast, in the embodiment of FIG. 10, the spring 173 that actuates the striker 172 is preloaded. This means that in general, the embodiment of FIG. 5 provides for more safety since accidental ignition due to the release of the striker (i.e., 172 in the embodiment of the FIG. 10) cannot occur in the embodiment of FIG. 5.

Figure 11A:
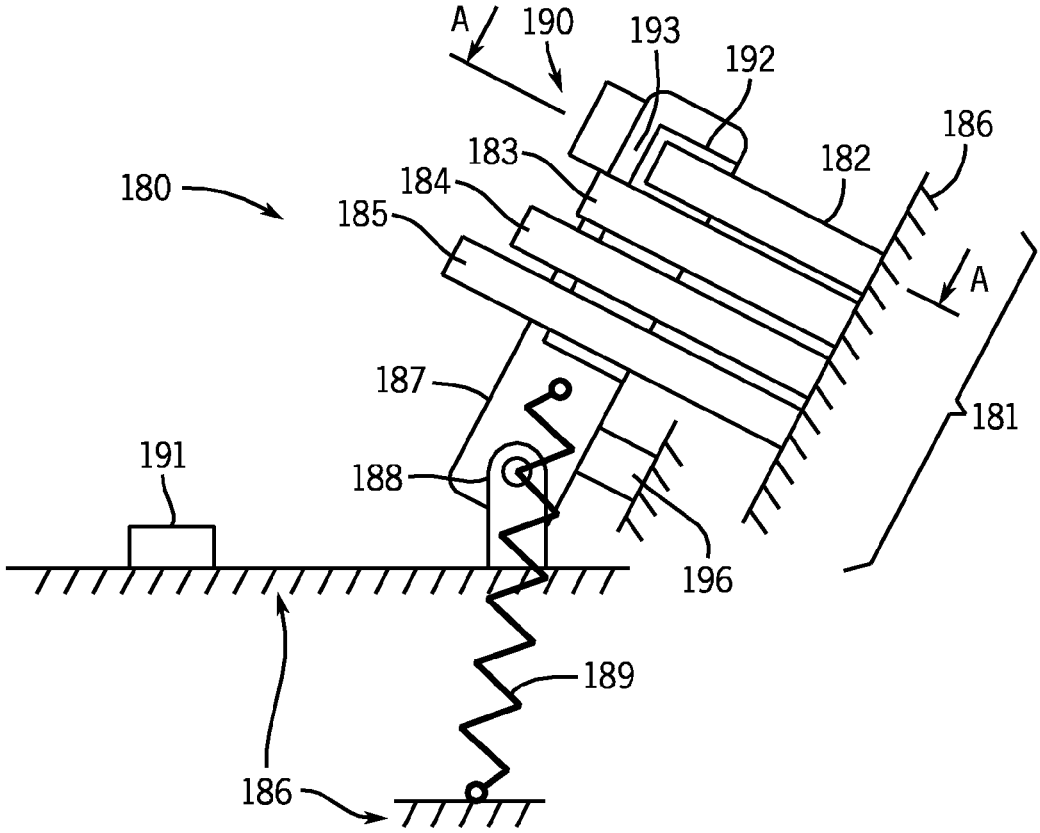
FIG. 11*a* illustrates an isometric view of yet another embodiment of an inertia igniter configured to initiate pyrotechnic materials.

In yet another embodiment 180, the mechanical delay mechanism portion 181 is combined with a striker and pyrotechnic part (the remaining components of the inertial igniter embodiment 180). The mechanical delay mechanism component 181 is a four-stage finger design with fingers 182, 183, 184 and 185, similar to the multi-stage fingers of the embodiments of FIGS. 5, 9 and 10. The four-stage fingers 182, 183, 184 and 185 are fixed at one end to the inertial igniter structure 186 as shown in FIG. 11*a* and the section A-A illustrated at FIG. 11*b*. The free end of the fingers 182, 183, 184 and 185 are provided with a preferably rounded extension 195.

The striker component of the inertial igniter 180 is a toggle type of mechanism with the toggle link 187, which is attached to the structure of the inertial igniter 180, by a pin joint indicated with numeral 188. In its rest and normal position, the striker (toggle) link 187 is biased to rest on its right-most position shown in FIG. 11*a*, against the stop 196, by the spring 189. The spring 189 is preloaded in tension, and serves as the toggle mechanism spring, and is attached to the structure 186 on one end and to the striker link 187 on the other end, preferably with pin or pin-like joints. The surface of the striker link 187 that faces the multi-stage mechanical delay mechanism 181 is provided with a sloped section 192, shown in FIG. 11*a* and in the cross-section A-A in FIG. 11*b*. The elements 190 and 191, fixed to the striker link 187 and the inertial igniter structure 186, respectively, are the two components of the ignition pyrotechnic. Alternatively, a one piece pyrotechnic element may be used, in which case the element 190 is preferably the ignition impact mass or pin and the element 191 is preferably the one piece impact initiated pyrotechnic element.

Each finger 182, 183, 184 and 185 is provided with certain amount of mass and deflection resisting elasticity (in this case in bending). Certain amount of upward preloading may also be provided to delay finger deflection until a desired acceleration level is reached. When at rest, only the extension 195 of the first finger 182 is resting on the sloped surface 192 of the striker link 187. The extensions 195 of the other fingers 183, 184 and 185 rests on the top (flat) surface 193 of the striker link 187.

Figure 11B:
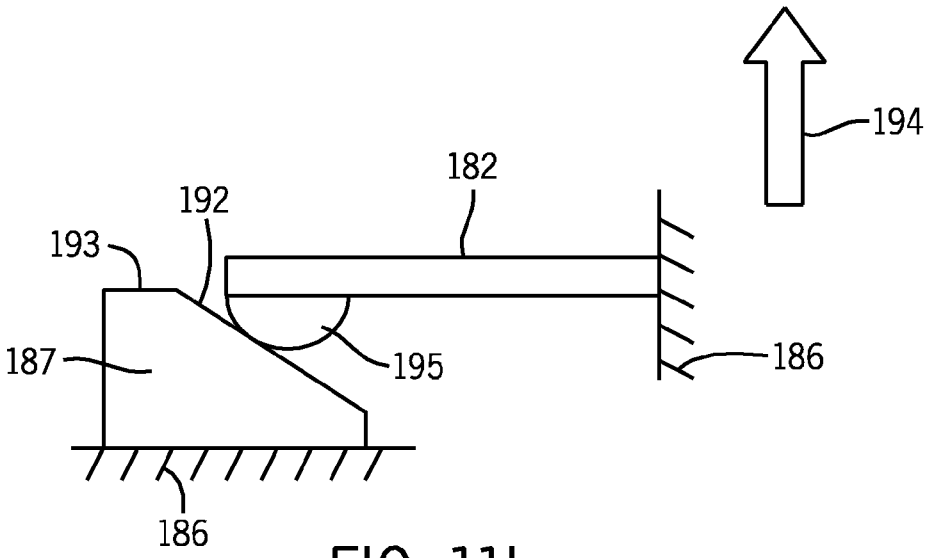
FIG. 11*b* illustrates a sectional view of FIG. 11*a* as taken along line A-A in FIG. 11*a*.

The operation of the device is as follows. At rest, the striker link 187 is biased to the right by the spring 189, and the four fingers 182, 183, 184 and 185 are biased upwards with some pre-load. The ratio of pre-load to effective finger mass will determine the acceleration threshold below which there will be no relative movement between components. The positions of the four fingers 182, 183, 184 and 185 are such that the extension 195 of the finger 182 is over the sloped surface 192 of the striker link 187 as shown in FIGS. 11*a* and 11*b*, and extensions 195 of the fingers 183, 184 and 185 are supported by the top surface 193 of the striker link 187, and are prevented from moving until the striker link 187 has rotated a prescribed angle to the left (counterclockwise), allowing the next extension 195 of the next finger (finger 183) to move over the sloped surface 192. This is illustrated in FIG. 11*a*. If the device 180 experiences an acceleration in the direction 194, FIG. 11*b*, above the threshold determined by the ratio of initial resistances (elastic preloads) to effective component masses, the first stage finger 182 will act against the sloped surface 192 of the striker link 187, rotating it one step counterclockwise.

Figure 11C:
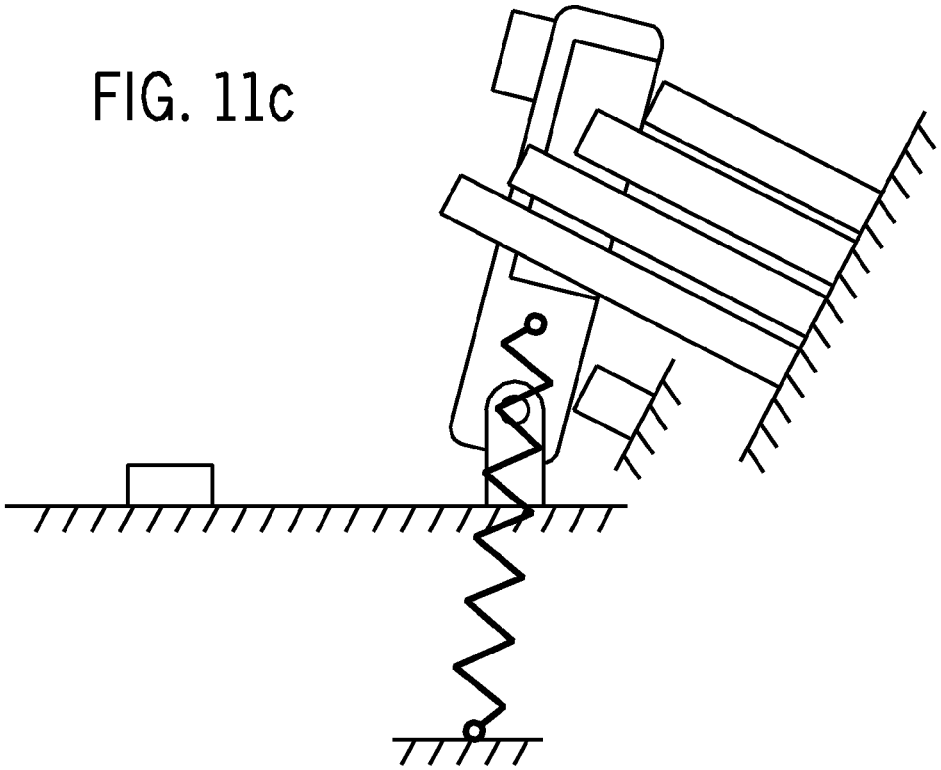
FIGS. 11*c*-11*e* illustrate the inertia igniter of FIG. 11*a* in various stages of acceleration.
Figure 11D:
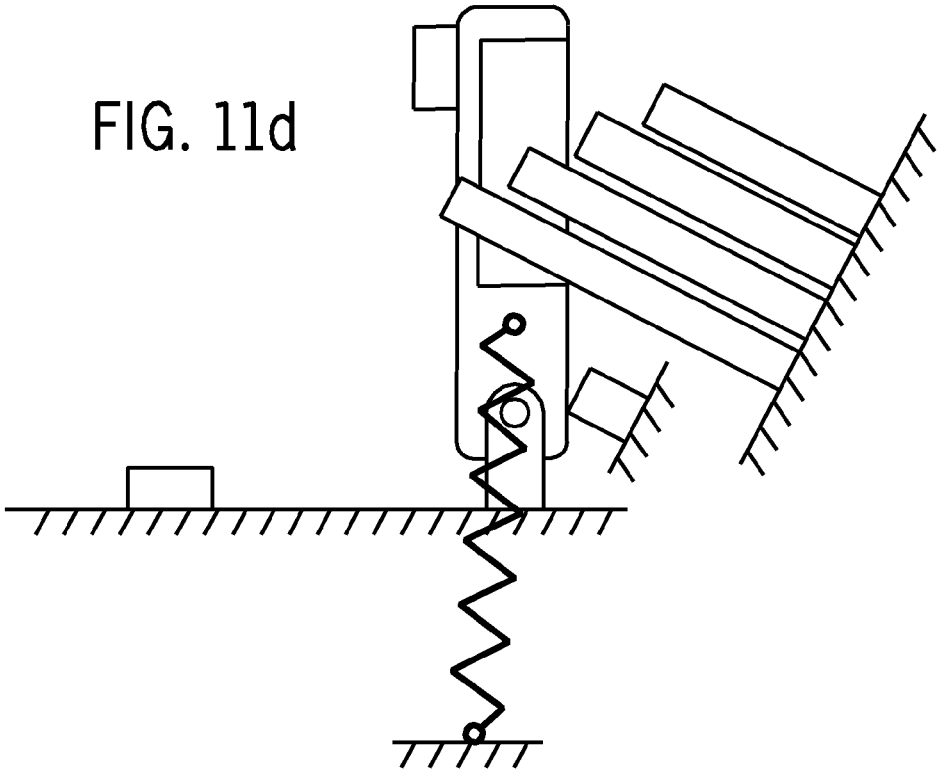
Figure 11E:
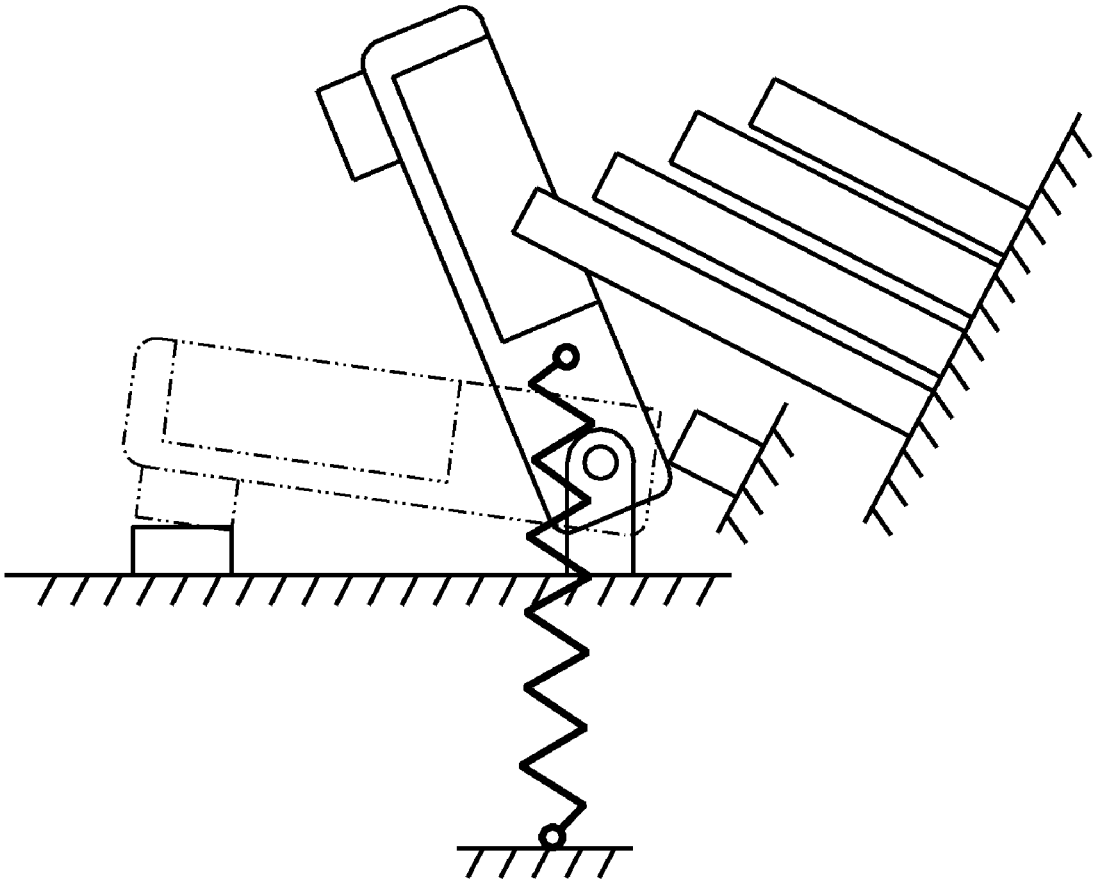

FIG. 11*c* shows the first finger 182 fully actuated and the striker link 187 advanced in rotation one step in the counterclockwise direction. At this instant, the second stage finger 183 is no longer supported by the top surface 193 of the striker link 187, and is moved over the sloped surface 192, and is therefore free to move downwards provided that the acceleration is still sufficiently high to overcome the preload for the second stage finger 183 and the striker link spring 189 force. If the acceleration continues at an all-fire profile, the second stage finger 183 will move down and rotate the striker link 187 further counterclockwise, allowing the extension 195 of the third stage finger 184 to move over the sloped surface 192. This is shown in FIG. 11*d*. If the acceleration continues at an all-fire profile, the third stage finger 184 and then the fourth stage finger 185 will sequentially move down and rotate the striker link 187 further counterclockwise. This is shown in FIG. 11*e*.

If the acceleration terminates or falls below the all-fire requirements any time before the last (fourth) stage finger 185 has actuated downward, the mechanical delay mechanism 181 will reverse until balance is achieved between the acceleration reaction forces and the elastic resistances. This may be a partial or complete reset from which the mechanism may be re-advanced if an all-fire profile is applied or resumed. If the fourth stage finger 185 is actuated downward as shown in FIG. 11*e*, the striker link 187 (the toggle mechanism) passes its spring 189 stabilized position on the right hand side of the inertial igniter 180, and is accelerated in the counterclockwise direction, until the pyrotechnic components 190 and 191 impact and cause ignition. The latter state of the striker link 187 is shown in dashed lines in FIG. 11*e*.

Besides use in munitions, as described above, the novel inertial igniters disclosed above have widespread commercial use and can be utilized in any application where a safe power supply having a very long shelf life is desired. Examples of such devices are emergency consumer devices, such as flashlights and communication devices, such as radios, cell phones and laptops. The inertial igniters disclosed above could provide such a power supply upon a required acceleration, such as striking the device upon a hard surface/ground.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A mechanical delay mechanism comprising:

a housing;

two or more members disposed in the housing, at least one end of each of the two or more members being sequentially movable upon at least one of an increasing magnitude and duration of an acceleration of the housing; and a movable member rotatable within the housing by the sequential movement of the two or more members;

wherein the two or more members are two or more finger members, each cantilevered from the housing at the one end and free to deflect at an other end.

2. The mechanical delay mechanism of claim 1, further comprising a biasing member configured to bias the movable member in a first direction when the movable member rotates less than a predetermined amount and to bias the movable member in a second direction when the movable member rotates more than the predetermined amount.

3. The mechanical delay mechanism of claim 2, wherein the first direction is towards a rest position of the movable member prior to an initiation of the acceleration and the second direction is a direction opposite to the first direction.

4. The mechanical delay mechanism of claim 1, further comprising an inertia igniter having an ignition member, the inertia igniter being coupled to the housing such that movement of the movable member by the two or more members ignites the ignition member.

5. The mechanical delay mechanism of claim 1, wherein the movable member is rotatable about a first end and the other end of the two or more finger members engage a second end of the movable member.

6. The mechanical delay mechanism of claim 5, wherein the movable member has a tapered surface at the second end for engagement with the other end of the two or more finger members to facilitate movement of the movable member by the deflection of the other end of the two or more finger members against the tapered surface.

7. An inertia igniter comprising:

a mechanical delay mechanism having two or more members and a movable member, the two or more members being movable upon at least one of an increasing magnitude and duration of an acceleration to sequentially move the movable member upon sequential movement of the two or more members; and an ignition member actuatable by the movable member such that rotation of the movable member by the two or more members ignites the ignition members;

wherein the two or more members are two or more finger members, each cantilevered from a housing at the one end and free to deflect at an other end.

8. The inertia igniter of claim 7, further comprising a biasing member configured to bias the movable member in a first direction when the movable member rotates less than a predetermined amount and to bias the movable member in a second direction when the movable member rotates more than the predetermined amount.

9. The inertia igniter of claim 8, wherein the first direction is towards a rest position of the movable member prior to an initiation of the acceleration and the second direction is a direction towards an ignition direction.

10. The inertia igniter of claim 7, wherein the movable member is rotatable about a first end and the at least other end of each of the two or more finger members engage a second end of the movable member.

11. The inertia igniter of claim 10, wherein the movable member has a tapered surface at one end for engagement with the other end of the two or more finger members to facilitate movement of the movable member by the deflection of the other end of the two or more finger members against the tapered surface.

12. A mechanical delay mechanism comprising:

two or more members, at least one end of each of the two or more members being sequentially movable upon at least one of an increasing magnitude and duration of an acceleration event;

a movable member rotatable in an actuation direction by the sequential movement of the two or more members, the movable member preventing each of the two or more members from moving until a previous one of the two or more members has moved the movable member a predetermined distance to release a subsequent one of the two or more members; and a biasing member configured to bias the movable member opposite to the actuation direction when the movable member rotates less than a predetermined amount and to bias the movable member in the actuation direction when the movable member rotates more than the predetermined amount.

13. The mechanical delay mechanism of claim 12, wherein the two or more members are two or more finger members, each cantilevered from a housing at the one end and free to deflect at an other end.

14. The mechanical delay mechanism of claim 13, wherein the movable member is rotatable about a first end and the other end of the two or more finger members engage a second end of the movable member.

15. The mechanical delay mechanism of claim 14, wherein the movable member has a tapered surface at the second end for engagement with the other end of the two or more finger members to facilitate movement of the movable member by the deflection of the other end of the two or more finger members against the tapered surface.

* * * * *